US010533328B2

(12) United States Patent
Apostolopoulos et al.

(10) Patent No.: US 10,533,328 B2
(45) Date of Patent: Jan. 14, 2020

(54) QUAD-CHORD TRUSS AND PLATFORM CONTAINING SAME

(71) Applicant: Paul Kristen, Inc., Tonawanda, NY (US)

(72) Inventors: Lambros Apostolopoulos, East Aurora, NY (US); Davy E. Passucci, Clarence Center, NY (US); Brian Bortz, North Tonawanda, NY (US)

(73) Assignee: Paul Kristen, Inc., Tonawanda, NY (US)

( * ) Notice: Subject to any disclaimer, the term of this patent is extended or adjusted under 35 U.S.C. 154(b) by 0 days.

(21) Appl. No.: 15/845,903

(22) Filed: Dec. 18, 2017

(65) Prior Publication Data

US 2018/0148941 A1 May 31, 2018

Related U.S. Application Data

(62) Division of application No. 14/876,282, filed on Oct. 6, 2015, now Pat. No. 9,896,852.

(51) Int. Cl.
*E04G 5/06* (2006.01)
*E04C 3/00* (2006.01)
(Continued)

(52) U.S. Cl.
CPC ..... *E04G 5/06* (2013.01); *E01D 22/00* (2013.01); *E04C 3/005* (2013.01); *E04C 3/04* (2013.01);
(Continued)

(58) Field of Classification Search
CPC ..... E04G 5/06; E04G 3/04; E01D 22/00
See application file for complete search history.

(56) References Cited

U.S. PATENT DOCUMENTS 2,106,084 A * 1/1938 Coddington ..... E04B 1/2403 52/376
2,744,590 A * 5/1956 Butts ..... E04B 5/14 52/645
(Continued)

FOREIGN PATENT DOCUMENTS

CN 203938385 U 11/2014
JP H1113276 A 1/1999
(Continued)

OTHER PUBLICATIONS

Supplemental Partial European Search Report for corresponding European application EP 16854178, dated May 21, 2019.
(Continued)

*Primary Examiner* — Alvin C Chin-Shue
(74) *Attorney, Agent, or Firm* — James C. Simmons

(57) ABSTRACT

A foldable quad-chord truss which can be connected end-to-end with like trusses. Each pair of chords are rigidly attached, and connector members intermediate the ends are swivelly attached to the chord pairs to effect the folding into a compact shape for transport and storage. The connector members are adapted for attachment to connector members of beams which may extend perpendicular to a parallel pair of the trusses and attached thereto. The laid trusses and beams is overlaid with sheets of corrugated sheet metal which overlap each other along their adjacent edges. While standing on a sheet of laid sheet metal adjacent ends of an already laid pair of trusses, another truss can be held adjacent the edge of the sheet metal for attaching an end of the other truss along only one side so that it can then be swung outwardly into a position wherein the other end of the other truss can also be attached to rigidly connect the trusses end-to-end.

14 Claims, 15 Drawing Sheets

(51) Int. Cl.

| | |
|---|---|
| ***E04G 3/22*** | (2006.01) |
| ***E04G 5/16*** | (2006.01) |
| ***E04G 1/15*** | (2006.01) |
| ***E01D 22/00*** | (2006.01) |
| ***E04C 3/04*** | (2006.01) |
| ***E04C 3/08*** | (2006.01) |
| ***E04G 3/00*** | (2006.01) |
| ***E04G 11/38*** | (2006.01) |
| ***E04G 11/50*** | (2006.01) |
| *E01D 19/10* | (2006.01) |
| *E04G 1/34* | (2006.01) |
| *E04G 3/30* | (2006.01) |

(52) U.S. Cl.

CPC ..... *E04C 3/08* (2013.01); *E04G 1/152* (2013.01); *E04G 3/00* (2013.01); *E04G 3/22* (2013.01); *E04G 5/165* (2013.01); *E04G 11/38* (2013.01); *E04G 11/50* (2013.01); *E01D 19/106* (2013.01); *E04C 2003/0486* (2013.01); *E04C 2003/0491* (2013.01); *E04G 1/34* (2013.01); *E04G 3/30* (2013.01); *E04G 2001/158* (2013.01)

(56) References Cited

U.S. PATENT DOCUMENTS 5,711,131 A * 1/1998 Thomas ..... E04C 3/08 403/170
5,771,655 A * 6/1998 Strickland ..... E04B 5/10 52/650.3
6,079,178 A * 6/2000 Fisher ..... E04C 3/08 52/634
6,675,546 B2 * 1/2004 Coles ..... F16B 7/185 403/157
7,703,615 B2 * 4/2010 Willim ..... B66C 23/70 212/175
7,779,599 B2 * 8/2010 Jolicoeur ..... E01D 19/106 52/650.3
8,123,001 B1 * 2/2012 Apostolopoulos .... E01D 19/106 182/150
8,720,152 B2 * 5/2014 Kempf ..... E04B 1/2403 52/167.1
2013/0055671 A1 * 3/2013 Bruce ..... E04B 1/3483 52/646
2016/0090741 A1 * 3/2016 Jobin ..... E04C 3/005 52/646
2016/0264384 A1 * 9/2016 Roodenburg ..... B66C 23/70
2017/0144867 A1 5/2017 PaBmann et al.

FOREIGN PATENT DOCUMENTS

JP 2004270403 A 9/2004
WO 2014186906 A1 11/2014

OTHER PUBLICATIONS

Provisional Opinion Accompanying the Partial Search Result for corresponding European application EP 16854178, dated May 29, 2019.

* cited by examiner

QUAD-CHORD TRUSS AND PLATFORM CONTAINING SAME

This application is a divisional of application Ser. No. 14/876,282, filed Oct. 6, 2015, which application is hereby incorporated herein by reference.

FIELD OF THE INVENTION

The present invention relates generally to trusses and to platforms such as may be erected below a bridge deck or other structures for cleaning, painting, or other maintenance work thereon, or for any other suitable purpose. As used herein and in the claims, the term "platform" is also meant to include scaffolding. While disclosed herein as being used for platforms and other scaffolding, it should be understood that trusses may also be used for other purposes.

BACKGROUND OF THE INVENTION

Prior art platforms include those disclosed in Applicant's U.S. Pat. Nos. 5,730,248; 5,921,346; 6,003,634; 6,135,240; 6,138,793; 6,227,331; 6,264,002; 6,302,237; 6,386,319; and 6,523,644.

A modular trussed platform is described in Australian patent 774316 which utilizes cluster posts between which truss units are attached, which allows the trusses to span in both longitudinal and transverse directions.

U.S. Pat. Nos. 7,779,599 and 7,941,986 disclose a work platform wherein a plurality of joists, such as trusses, are pivotally attached to a plurality of hubs.

U.S. Pat. No. 8,123,001 discloses a modular platform/scaffolding which does not utilize underlying cables but instead relies on the use of, for example, cables attaching the platform to an upper structure or supports from below for supporting the platform.

A quad-chord truss is one which has four elongate members or chords which extend longitudinally of the truss, with bracing or the like connecting the chords to form a rigid unitary framework, i.e., the truss. Examples of quad-chord trusses are found in U.S. Pat. Nos. 5,711,131, 6,026,626, and 7,028,442.

All patents and published patent applications disclosed herein are incorporated herein by reference.

SUMMARY OF THE INVENTION

It is an object of the present invention to improve the load capacity of a modular platform without an increase in weight, in certain embodiments.

It is another object of the present invention to provide a quad-chord truss which is foldable for storage and transport yet is deployable for building a platform, in certain embodiments.

It is still another object of the present invention to provide for fast and easy installation of a platform with low installation fatigue of the workers, in certain embodiments.

It is another object of the present invention to provide a modular platform/scaffolding structure which can be erected and dismantled easily and safely and quickly, without the necessity of cranes or other heavy equipment, in certain embodiments.

It is yet another object of the present invention to provide a modular structure which has the flexibility in erecting to allow building around obstacles and in tight areas, in certain embodiments.

It is a further object of the present invention to provide a modular structure wherein some or all of the individual components can be manipulated and attached and unattached by a single person, in certain embodiments.

It is yet another object of the present invention to provide a modular structure wherein the floor is sealed easily, in certain embodiments.

It is a still further object of the present invention to provide for the laying of flooring without the need for a complete box (a frame all the way around) so that workers can "build as they go," in certain embodiments.

It is yet another object of the present invention to provide a modular structure wherein there are a small number of types of structural members so that support points are not specific, i.e., if structural members are removed, integrity is not sacrificed because new structural members can be added where needed, in certain embodiments.

With reference to the corresponding parts, portions, or surfaces of the disclosed embodiments, merely for the purposes of illustration and not by way of limitation, in accordance with certain aspects/embodiments of the present invention, a quad-chord truss is provided which is foldable so that it takes up less space for storage and transport yet is deployable for building. The truss comprises a first and a second pair of chords with webbing rigidly attaching the first pair of chords and webbing rigidly attaching the second pair of chords, and two or more spaced members interconnect the first pair of chords with the second pair of chords in a manner to effect folding of said chords between a first position wherein said first pair of chords is rigidly spread apart from said second pair of chords for use in a platform and a second position wherein said first pair of chords is folded next to said second pair of chords for transport and storage thereof. A quad-chord truss may be used as a frame member in a platform to provide increased load capacity.

The above and other objects, features, and advantages of the present invention will be apparent from the following detailed description of the preferred embodiment(s) thereof when read in conjunction with the appended drawings wherein the same reference numerals denote the same or similar parts throughout the several views.

DETAILED DESCRIPTION OF THE PREFERRED EMBODIMENT(S)

Figure 1:
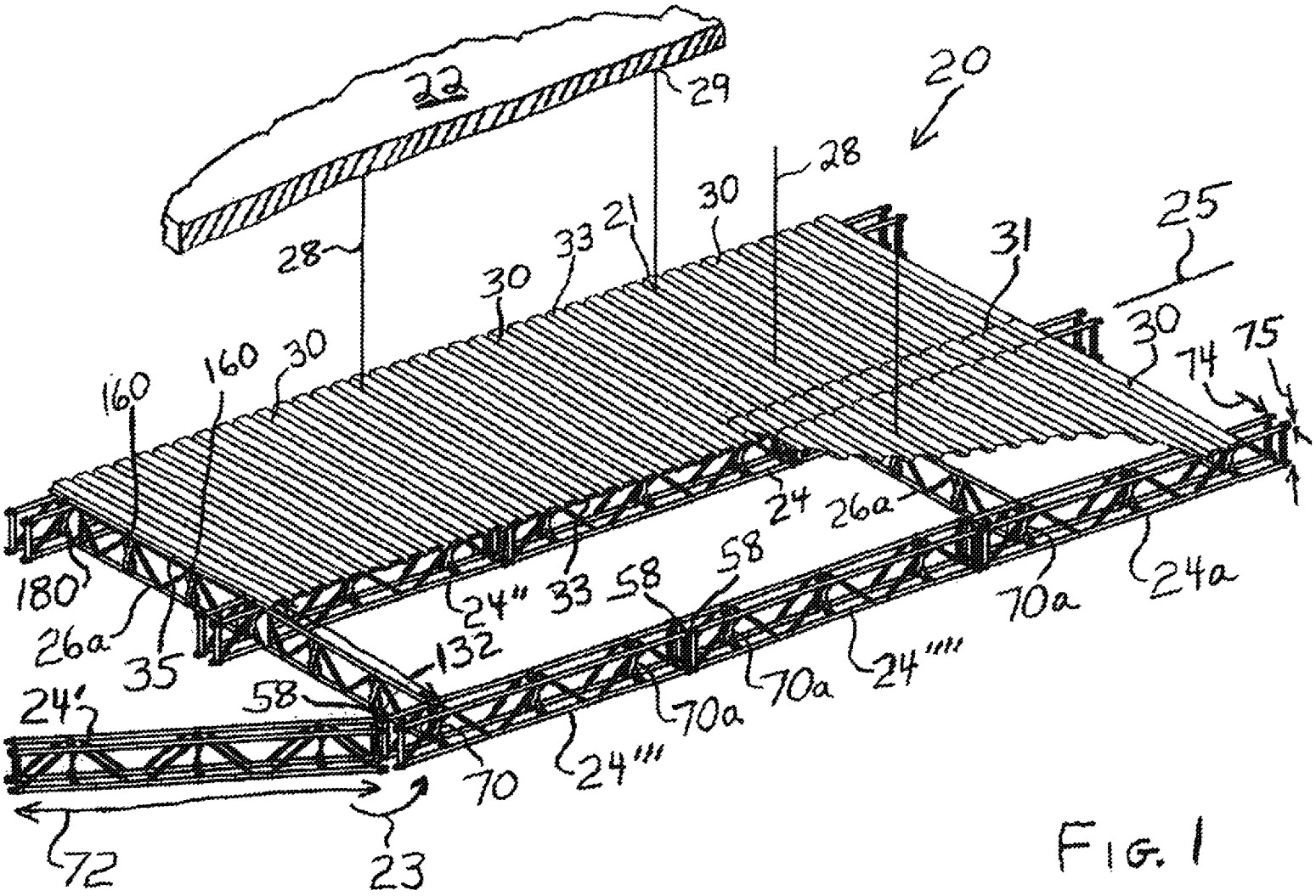
FIG. 1 is a perspective view, partly schematic, of a portion of a platform which illustrates a first embodiment (24*a*) of frame beams having a first or concave embodiment of connector members and a first embodiment (26*a*) of cross beams having mating connector members (70*a*) in accordance with the present invention, in the process of being built and with a portion of flooring partially cut away for ease of illustration.

Referring to FIG. 1, there is shown generally at 20 a portion of a modular platform which may be used, for example, for work such as cleaning or painting to be conducted on a bridge a portion of a structural member of which is illustrated at 22 and sectioned for ease of illustration. The platform 20 may also be used for any other suitable purpose such as for scaffolding.

Referring to FIG. 1, the platform 20 includes a plurality of interconnected frame beams or trusses 24 (a first embodiment 24*a* thereof) extending length-wise of the bridge 22. For example, FIG. 1 shows three groups of frame beams 24*a* with the frame beams 24*a* in each group being connected end-to-end and with the frame beams in each group being generally parallel to the frame beams in each of the other groups.

The platform further includes cross beams or trusses 26 (a first embodiment 26*a* thereof) which are provided to mate therewith as hereinafter discussed and which extend width-wise of the bridge 22 each between and connecting a pair of generally parallel frame beams 24*a*. It should be understood that hereinafter discussed mating beams of the second embodiments 24*b* and 26*b* thereof may be substituted therefor as suitable and appropriate. It should of course be understood that, alternatively, the frame beams may extend width-wise of the bridge 22 and the cross beams may extend length-wise of the bridge 22 (and of course in other directions, as may be desired and suitable) and it being further understood that frame beams in a particular platform may extend both length-wise and width-wise and that cross beams may extend between any adjacent pair of frame beams, as desired and suitable for a particular platform or other scaffolding design.

Figure 24:
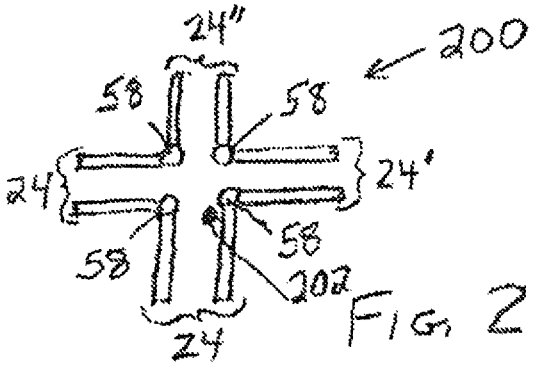
FIG. 24 is a schematic illustration of one way of connecting the frame beams.

For example, the frame beam 24' may be swung over from the position shown and attached to frame beam 24" (assuming its length permitted such), as apparent from FIG. 24.

More specifically, FIG. 1 shows three groups of parallel frame beams 24 with each group shown connected end-to-end co-axially, as illustrated by their having a common longitudinal axis, illustrated at 25. However, the frame beams 24 in a group need not all be co-axial and a frame beam may be joined at an angle to an other frame beam, as discussed hereinafter with respect to FIG. 13 as well as FIG. 24.

It should be understood that the platform 20 may have any number of groups of frame beams 24 and any number of frame beams 24 in each group, for example, the number of groups may be determined by the bridge width or portion thereof to be spanned, and the number of frame beams 24 in each group determined by the bridge length or portion thereof to be spanned.

The frame beams 24 are desirably, but need not be, all identical, and the cross beams 26 are also desirably, but need not be, all identical to thereby desirably minimize the number of types of platform construction parts in inventory.

Vertical cables or chains, illustrated schematically at 28, or the like, connect the beams or trusses 24 and 26 to the overhanging bridge or other structure 22 for support of the platform 20.

The cables 28 are suitably connected at ends thereof to the bridge structure 22 as indicated at 29. The cables 28 are also connected at their other ends via shackles (not shown) at 21 to eye-bolts (not shown) which are in turn attached to the trusses 24 and 26, as discussed hereinafter, or via other suitable means commonly known to those of ordinary skill in the art to which the present invention pertains. As long as sufficient support is provided, it is of course not necessary that every single truss 24 and 26 be connected to the bridge structure 22 by a cable 28, and a single truss may be supported by two or more cables 28. Instead of being supported by hanging from cables, it should be understood that platform 20 may be supported from below, for example, by columns on which some or all of the trusses 24 and 26 are supported, or may otherwise be suitably supported.

Flooring or decking, illustrated at 30, such as, for example, corrugated aluminum or other metal sheets or sheets made of other suitable material, is laid across the beams 24 and 26 and secured thereto as is discussed in greater detail hereinafter or in other ways commonly known to those of ordinary skill in the art to which the present invention pertains, to complete the platform 20. Each of the deck sheets 30 is shown to be laid to extend between and overlie frame beams 24 on both sides respectively and also overlies adjacent cross beams 26 as may be appropriate and be connected thereto and to each other, and thus, preferably, their side edges 33 overlap as illustrated by the dashed lines at 31.

Similarly and preferably, their end edges 35 overlie the respective cross beams 26 and also overlap. It should be understood that various other deck panel layouts are envisioned, for example, the number of deck panels may vary and they may span between and overlie a greater number of cross beams 26 and/or a greater number of frame beams 24. While the decking 30 may be composed of planks, flat sheets, or any other suitable material, corrugated sheets for the decking 30 are especially preferred because the end and side edges 35 and 33 respectively may be easily overlapped to achieve a suitable seal without the requirement of additional hardware therefor.

Figure 20:
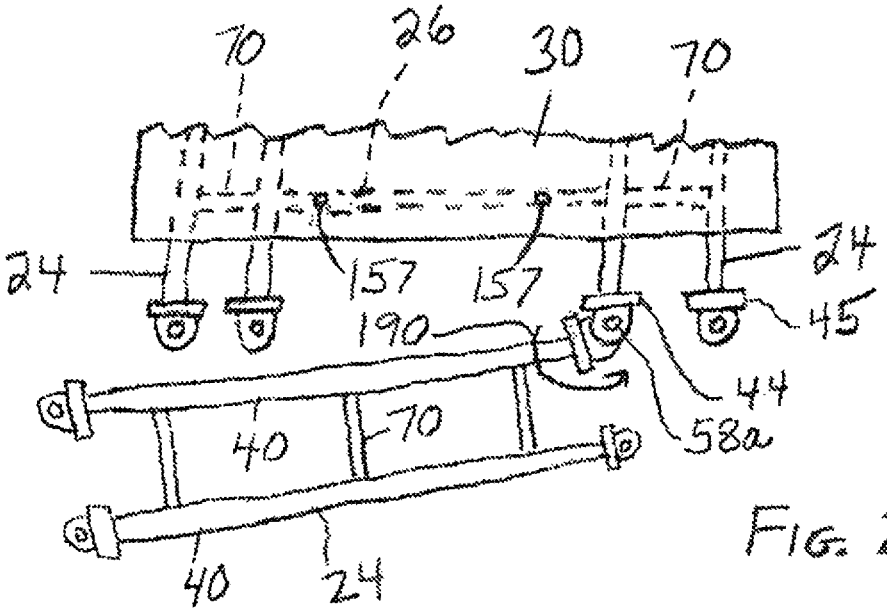
FIGS. 20 to 23 are sequential schematic illustrations of the process of erecting a platform in accordance with the present invention.

Moreover, in certain embodiments, corrugated sheets are also provided to desirably achieve an excellent weight to capacity ratio. Importantly, the corrugated panels 30 are also provided to lock the assembly rigidly into place, as discussed in greater detail hereinafter, whereby a complete box (trusses on all four sides) is not required to begin laying flooring, i.e., a panel may be laid adjacent where a beam is to be attached or may be temporarily laid as suitable to install a beam, as seen in FIG. 20 and discussed hereinafter. This allows a workman to stand on a temporarily laid portion of flooring to connect frame beams 24 and/or connect a cross beam 26 to complete the "box" and/or to permit the workmen to "build as you go." However, other suitable flooring may instead be used, such as, for example, plywood flooring, such as used in the platform of Applicant's aforesaid U.S. Pat. No. 8,123,001.

Each truss 24 and 26 (all embodiments thereof disclosed herein) is composed of a suitable steel to achieve high load capacity but may be composed of another suitable material such as, for example, aluminum or other suitable lightweight strong material.

While disclosed herein as being used in platforms and other scaffolding, it should be understood that the uses of the trusses 24 (as well as trusses 26) should not be considered as being limited to platforms and other scaffolding, but they may be used for any other suitable purpose.

While the present invention should not be considered as being limited to any particular size and weight of the trusses 24 and 26 and decking panels, it is nevertheless preferred that they be sufficiently short and/or of light weight to allow handling conveniently by two people working as a team, even more preferably by one person. A country's or state's regulations may require that the weight of a truss be less than 110 pounds for handling by two people acting as a team and less than 55 pounds for handling by one person, and the lengths thereof are desirably such as to allow easy and quick manipulation thereof (for connecting and dis-connecting) by two persons acting as a team, more preferably, by one person.

Accordingly, it is preferred that the weight of a truss be less than about 110 pounds, more preferably, less than about 55 pounds, with the length of each truss being such as to achieve such minimum weight as well as to allow such easy and quick manipulation. For example, each of the frame beams 24 may have a length, illustrated at 72 in FIGS. 1 and 19, of about 7½ feet and a width and height, illustrated at 74 and 75 respectively, of about 10 inches each.

Similarly, each corrugated panel has a weight which is preferably less than about 55 pounds, with its size being adequate for handling easily and conveniently by one or two people and desirable such as to overlap a pair of adjacent frame beams 24 and a pair of adjacent cross beams 26 to provide stability. The examples provided here and elsewhere in this specification are for exemplary purposes only and not for purposes of limitation.

Figure 19:
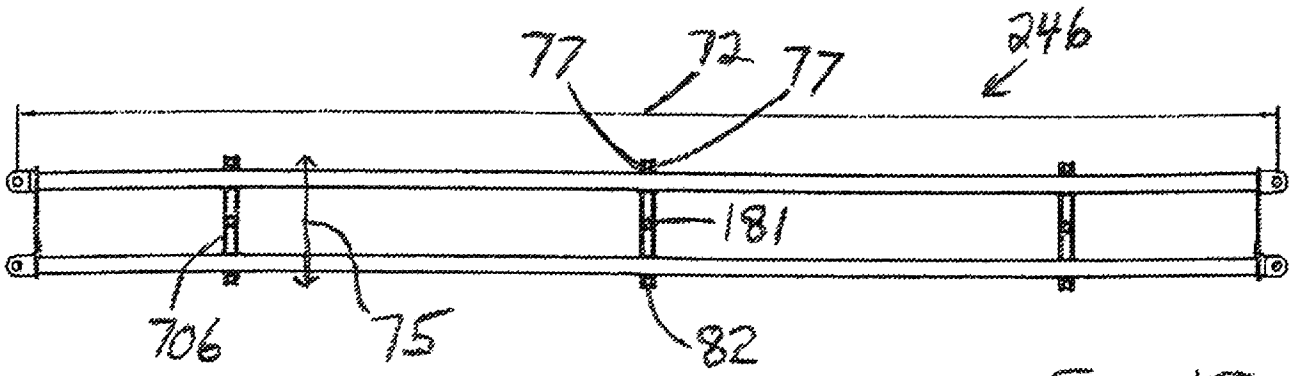
FIG. 19 is a plan view of the frame beam (second embodiment 24*b* thereof having the convex embodiment of the connector member 70*b*) of FIG. 11.
Figure 18:
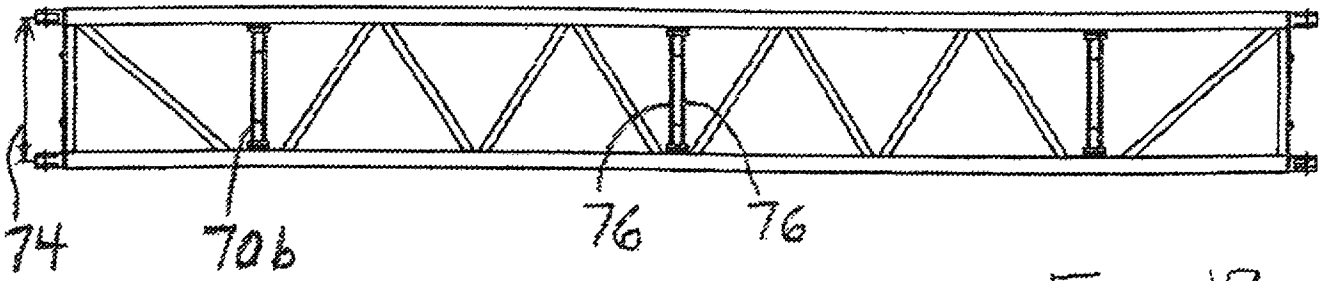
FIG. 18 is a side view of the frame beam (second embodiment 24*b* thereof having the convex embodiment of the connector member 70*b*) of FIG. 11.

The frame beams 24 need not have the same width and height, for example, as seen in FIGS. 18 and 19, the height 74 is, for example, about 10 inches while the width 75 is, for example, about 6 inches.

Figure 10:
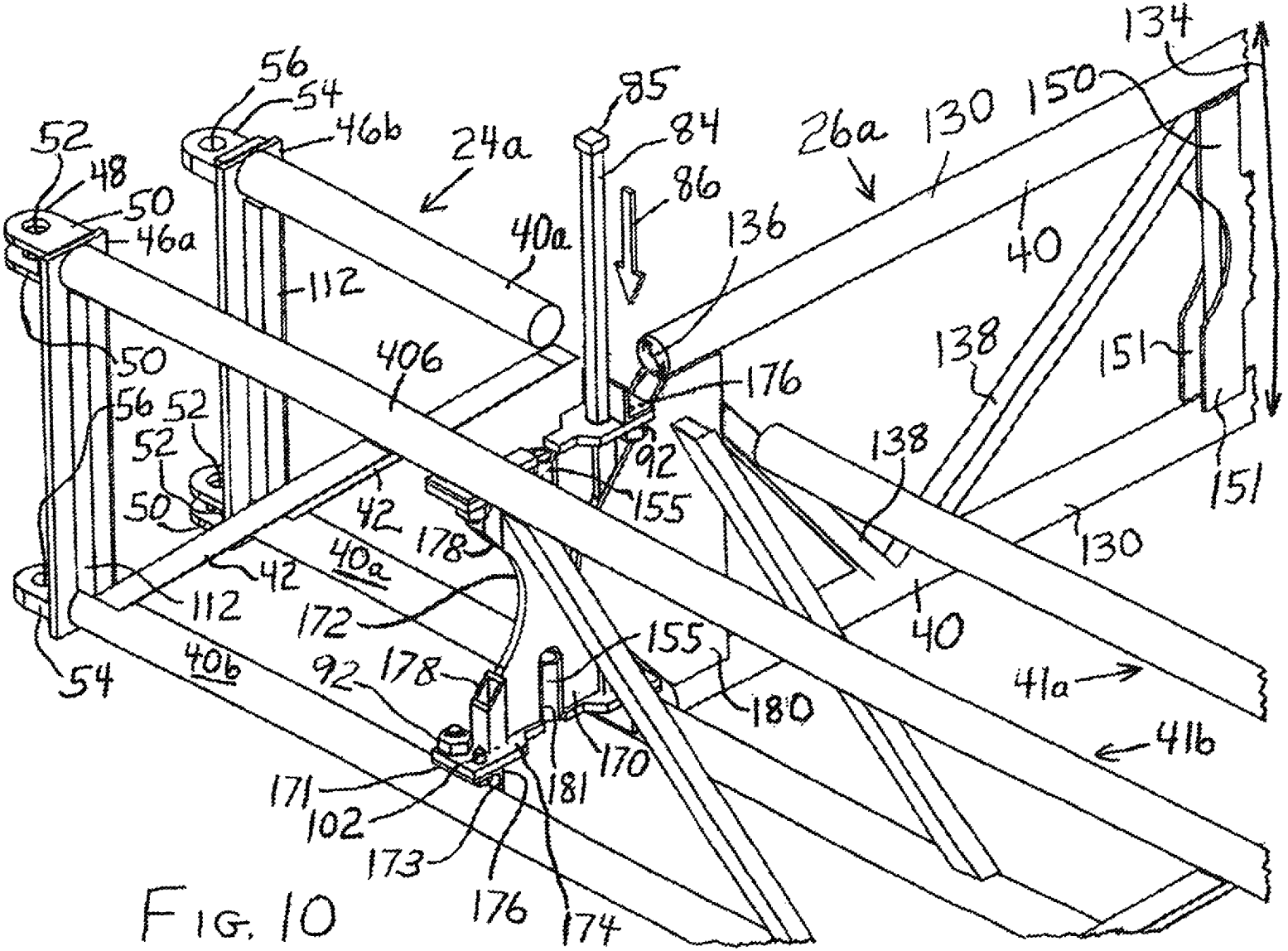
Figure 17:
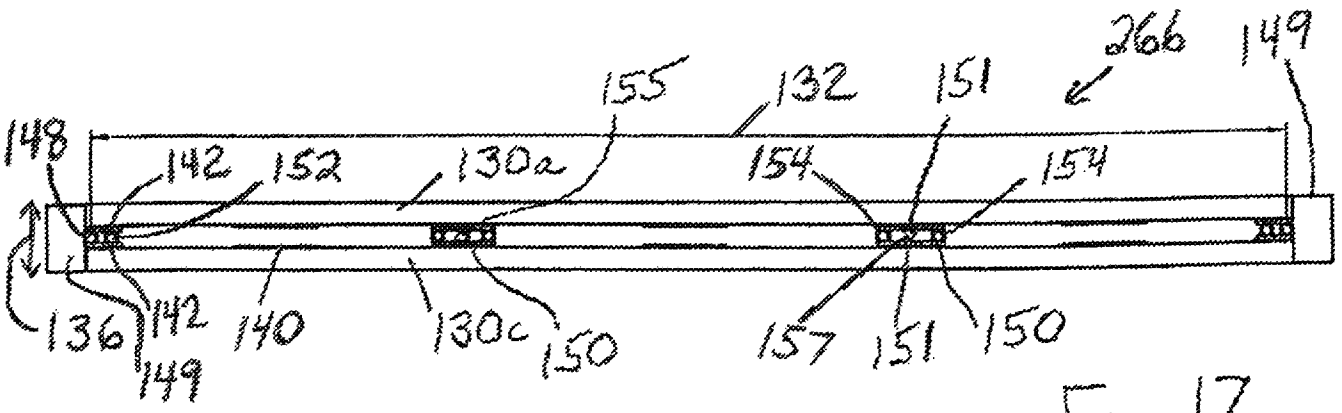
FIG. 17 is a plan view of the cross beam (second embodiment 26*b* thereof) of FIGS. 14 and 15.
Figure 16:
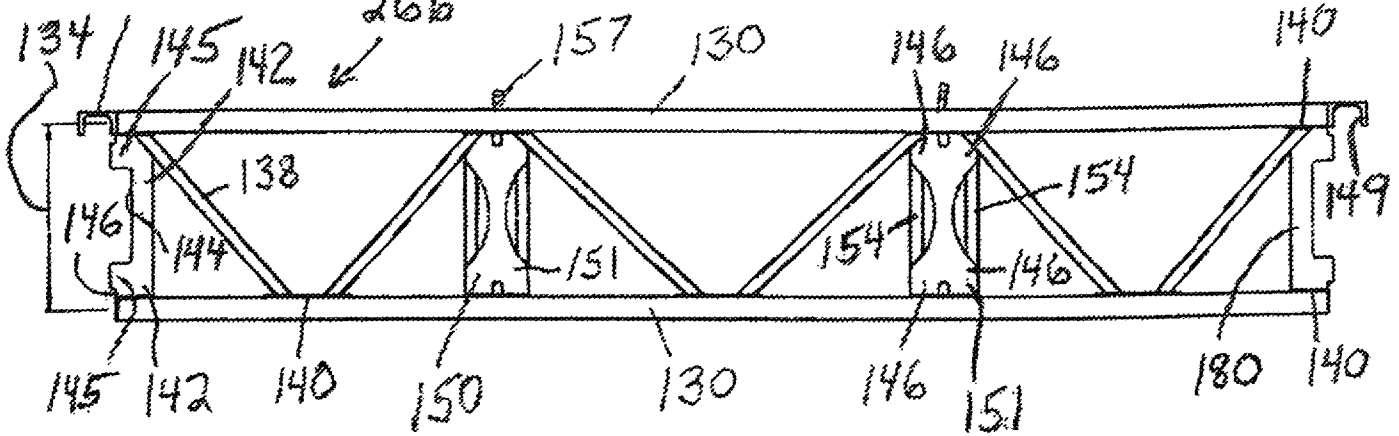
FIG. 16 is a side view of the cross beam (second embodiment 26*b* thereof) of FIGS. 14 and 15.

For example, each of the cross beams 26 may have a length, illustrated at 132 in FIGS. 1 and 17, of, for example, about 5½ feet and a height and width, illustrated at 134 and 136 respectively in the first embodiment of FIG. 10 of, for example, about 10 inches and about 1 inch respectively. The width 136 in this single-chord embodiment 26*a* of the cross beam (i.e., an embodiment wherein the cross beam has a single upper chord and a single lower chord, as opposed to a double-chord embodiment wherein the cross beam has two upper chords and two lower chords) is seen to be equal to about the diameter of the upper chord or tube. The double-chord embodiment of the cross beam 26*b* of FIGS. 16 and 17 has a pair of upper such tubes and a pair of lower such tubes thereby to provide increased strength, whereby its width would of course be equal to the diameter of each tube plus the spacing between the tubes. For example, the height and width, illustrated at 134 and 136 respectively in the double-chord embodiment 26*b*, of a cross beam of FIGS. 16 and 17 are, for example, about 10 inches and about 3 inches respectively. Using the process of assembly as more specifically discussed hereinafter, each of the platform components can be suitably sized to have a weight (preferably about 110 pounds or less, more preferably about 55 pounds or less, as discussed above) such that it can be easily and quickly manipulated and connected and disconnected by two persons, preferably by a single person, thus reducing the amount of required manpower for erecting and disassembling the platform 20. Moreover, this permits fast installation with minimal worker fatigue.

Figure 2:
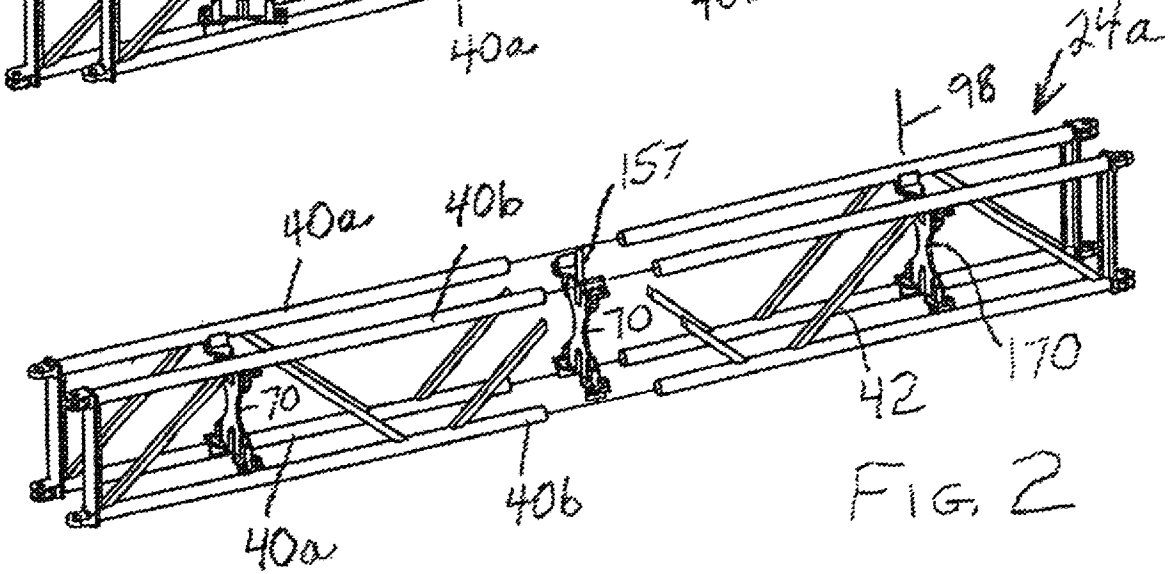
FIG. 2 is a perspective view, partly exploded, of one of the frame beams therefor in an unfolded condition for use in the platform.

Referring to FIG. 2, in order to increase or maximize truss capacity (amount of load it can support) with minimal increase in weight, the frame members 24 are preferably quad-chord trusses, i.e., a truss comprising four generally parallel chords or elongate members, illustrated at 40, each extending longitudinally over the length of the truss, and rigidly connected together by braces or webbing, illustrated at 42 and, in accordance with the present invention, two or more other members 70 spaced apart and whose additional purpose will be described in more detail hereinafter, but the means for rigidly connecting the chords together should not be considered as being limited thereto. To provide the desired strength and weight, each chord 40 is tubular (a hollow tube having an outer diameter of, for example, about 1 inch and a wall thickness of, for example, about 1/16 inch) but may, if desired, be solid rods or otherwise suitably shaped.

For the purposes of this specification and the claims, a truss is defined as a framework of chords interconnected by webbing such as girders or struts or bars or other members and having rigidity when in use for supporting a roof, bridge, floor or deck of a platform, or other structure. A truss may also be referred to herein and in the claims as a beam. While it is important that, while in use supporting a structure, a truss have the necessary rigidity, which may be sufficient by virtue of its interconnection with other trusses and/or flooring or the like, a truss in accordance with the present invention may be characterized in that it may be folded into a compact form for storage and transport, as hereinafter discussed with reference to FIGS. 3 to 5, and still be defined as a truss. For the purposes of this specification and the claims, a chord is defined as a principal elongate member of a truss and which extends longitudinally over the length of the truss. For the purposes of this specification and the claims, a "quad-chord truss" (or just "quad-chord") is defined as a truss which has four chords.

Figure 3:
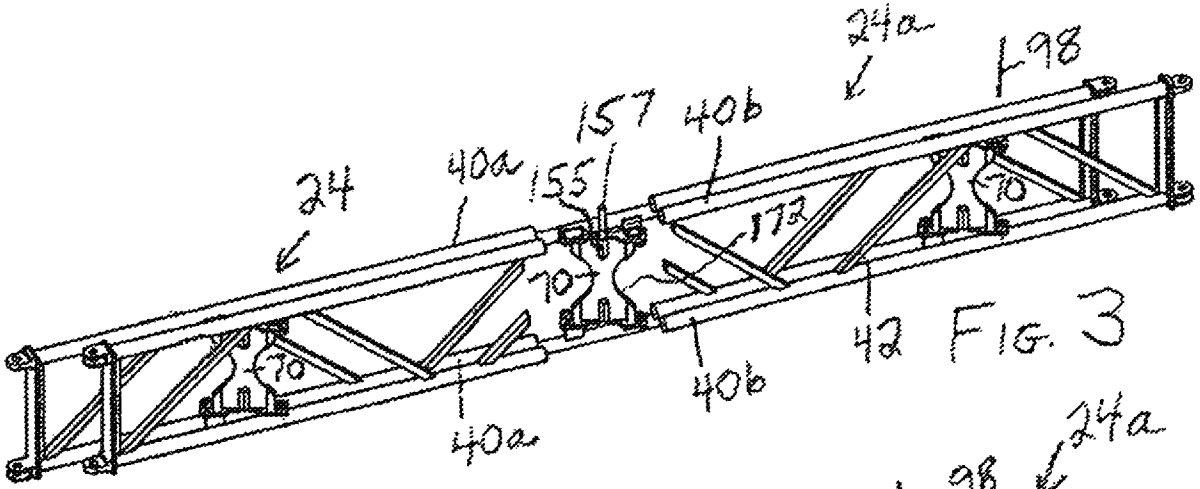
FIG. 3 is a view similar to that of FIG. 2 of the frame beam in a folded condition for storage and transport.

In order to reduce the space taken up by the quad-chord truss 24 during storage or stowage and transport, in accordance with the present invention, it is assembled to provide the necessary rigidity, as seen in FIG. 2, when in use supporting a structure yet is collapsible or foldable into a compact form, as seen in FIG. 3, for storage or stowage and transport.

Thus, the truss 24 has two pairs of chords 40*a* and 40*b* wherein the two chords of each pair of chords is permanently rigidly connected by webbing 42 in the form of a plurality of struts or braces extending diagonally between the respective chords and welded or otherwise suitably permanently attached thereto. By the term "permanently," as used herein and in the claims with respect to a pair of chords, is meant an attachment such as by welding of struts or braces between the pair of chords in a manner which causes the relationship between the pair of chords to remain rigid and without any means for relative movement there between.

Each pair of chords 40*a* and 40*b* and the webbing 42 interconnecting the respective pair is referred to herein as a chord pair 41*a* and 41*b*. Thus, the two chords 40*a* of chord pair 41*a* are permanently connected by webbing 42, and, likewise, the two chords 40*b* of chord pair 41*b* are permanently connected by webbing 42, but the chords 40*a* are not connected to chords 40*b* by such webbing 42 or otherwise permanently connected (although they are connected by other means as discussed hereinafter).

Figure 11:
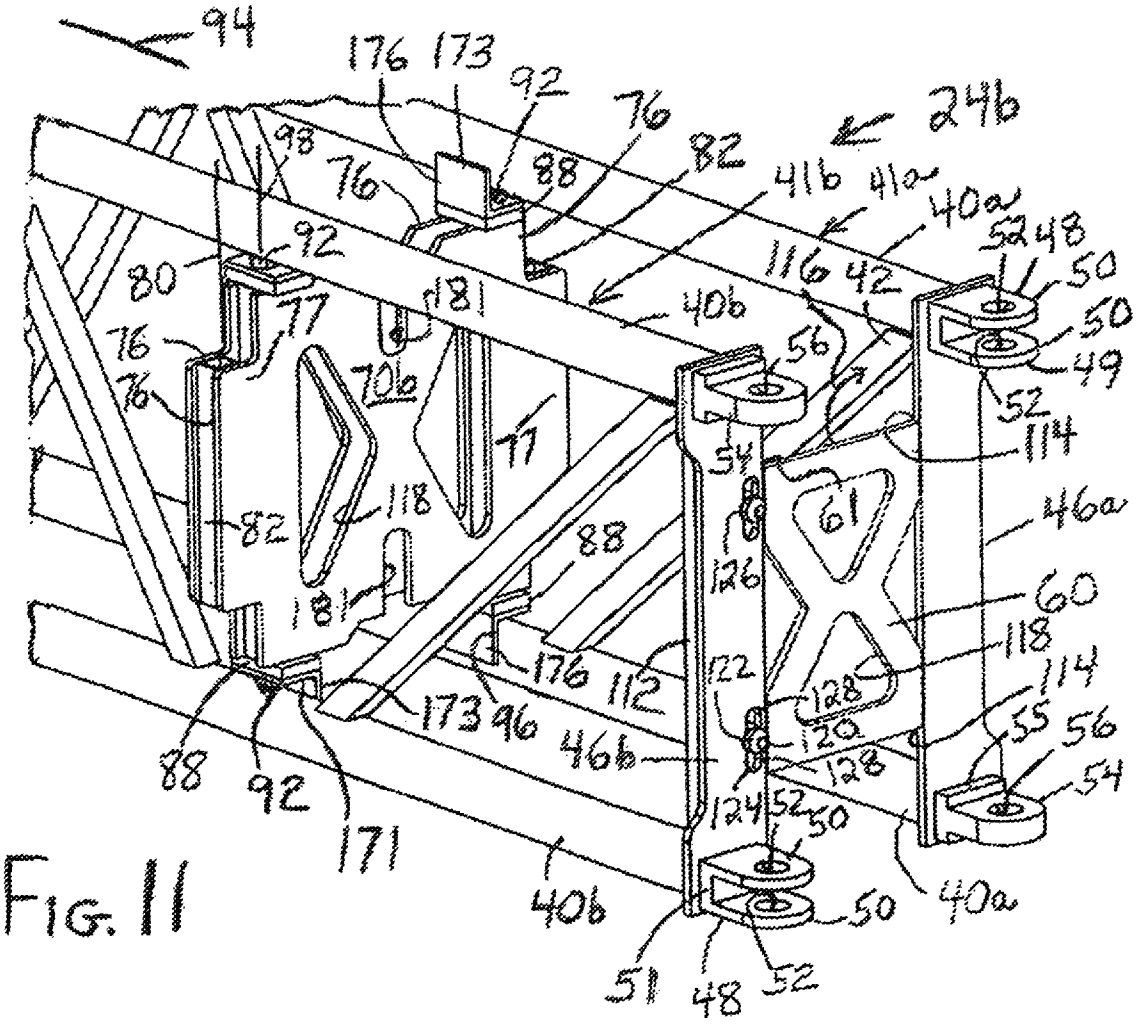
FIG. 11 is a partial perspective view of one of the frame beams in accordance with the second embodiment 24*b* (having a second or convex embodiment of the connector member 70*b*) of the present invention.

As best seen in FIGS. 10 and 11, at each end of a truss 24 (both 24*a* and 24*b*), the ends of the chords of each chord pair 41*a* and 41*b* are rigidly connected by an elongate plate 46 which has a width slightly greater than the respective chord diameter and which is welded or otherwise suitably rigidly connected to the respective chord ends.

In order to provide increased strengthening and to more rigidly secure the plates 46, a cross-sectionally rectangular (or otherwise suitably shaped) bar 112 extends between and is welded or otherwise suitably attached to the respective end portions of the respective chords 40 as well as to the respective plate 46 (for each of the chord pairs 41*a* and 41*b* respectively) and to an end of a respective webbing member 42. At or adjacent the upper end of one plate 46*a* is welded or otherwise suitably rigidly attached thereto a yoke 48 having a pair of vertically spaced ears 50 connected by an integral cross portion 51 and extending longitudinally outwardly therefrom and having rounded outer edges 49 and in which ears there are aligned apertures 52. At or adjacent the lower end of the same plate 46*a* is welded or otherwise suitably rigidly attached thereto a flange 54 (which has an integrally connected increased width cross portion 55 attached to the plate 46*a*) extending longitudinally outwardly therefrom and having an aperture 56. The width of flange 54 is desirably about twice the width of an ear 50 for commonly known strength of materials purposes. The three apertures 52 and 56 are in alignment. The other plate 46*b* also has a similar yoke 48 and a similar flange 54, but the yoke 48 on this other plate 46*b* is at or adjacent the lower end thereof and the flange 54 on this other plate is at or adjacent the upper end thereof. In order to connect one truss to another, a flange 54 of one truss is received in a yoke 48 of another truss at the upper ends of the respective truss plates 46 and a flange 54 of the other truss is received in a yoke 48 of the one truss at the lower ends of the same truss plates 46, and a pin, illustrated at 58 (FIGS. 1 and 12), is received (with use of a hammer if necessary), as illustrated at 59, in the respective three apertures or eyelets 52 and 56. It should be understood that only a single eyelet may be associated with each chord, or a pair or more of eyelets may be associated with each chord. The pin 58 is cylindrical to permit the needed rotation of a frame truss 24 during erection (attachment to another frame truss).

FIG. 1 shows truss 24' in the process of being rotated relative to an end of truss 24''', as indicated at 23. This alternate positioning of the yokes 48 and flanges 54 permits interchangeability of frame trusses so that all of the frame trusses 24 may desirably be identical, which advantageously reduces the number of types of parts in inventory.

Of course, if desired, inventory may comprise trusses 24 and/or trusses 26 of more than one length. As can be seen by the orientation of trusses 24''' and 24'''' in FIG. 1, a pair of trusses 24 may be positioned in an end-to-end relationship wherein they extend in the same longitudinal direction (by attachment of chord pair 41*a* of one to chord pair 41*b* of the other and by attachment of chord pair 41*b* of the one to chord pair 41*a* of the other) or they may be attached to extend perpendicular to each other (by attachment of chord pair 41*a* of one to chord pair 41*b* of the other, as seen by the relationship of trusses 24' and 24''' in FIG. 1, and chord pair 41*b* of the one 24' may then be attached to a different truss, as seen in FIGS. 1 and 24).

Figure 13:
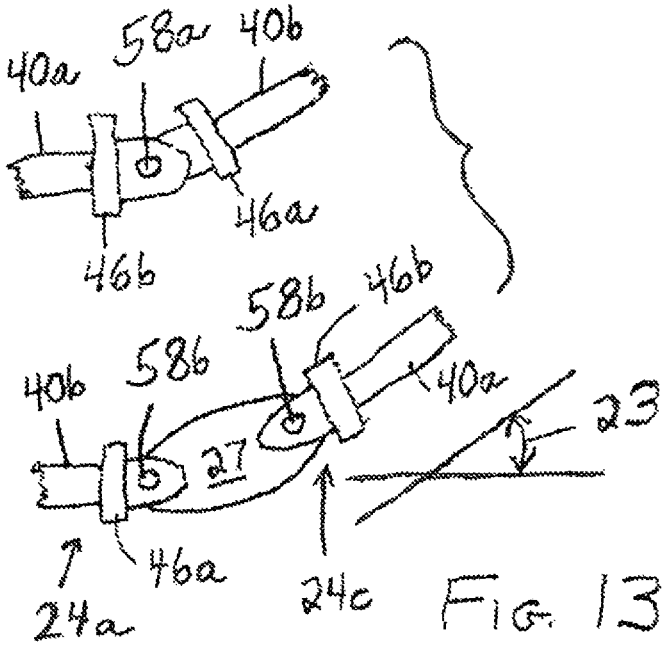
FIG. 13 is a schematic view illustrating the connecting of two of the frame beams (either of the first and second embodiments thereof) at a desired angle relative to each other.
Figure 14:
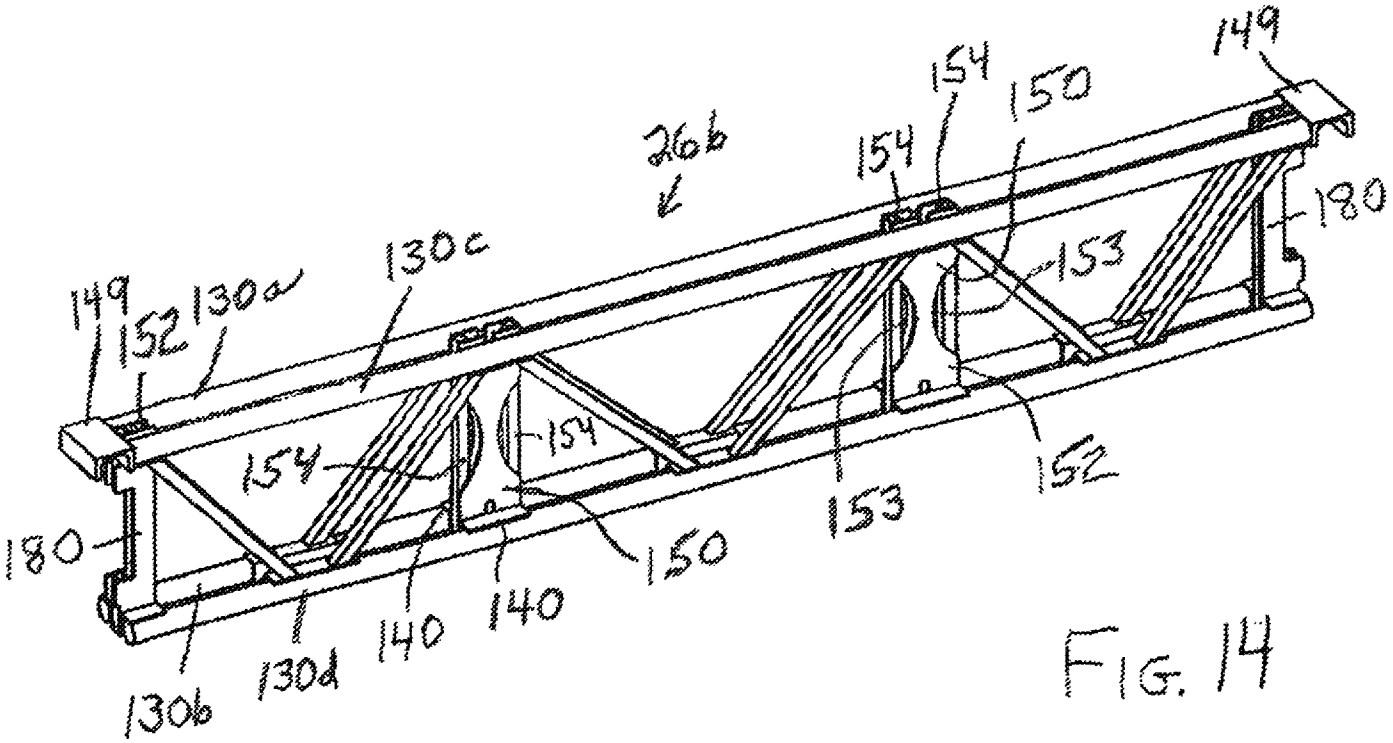
FIG. 14 is a perspective view of the cross beam (second embodiment 24*b* thereof) of FIG. 12.
Figure 15:
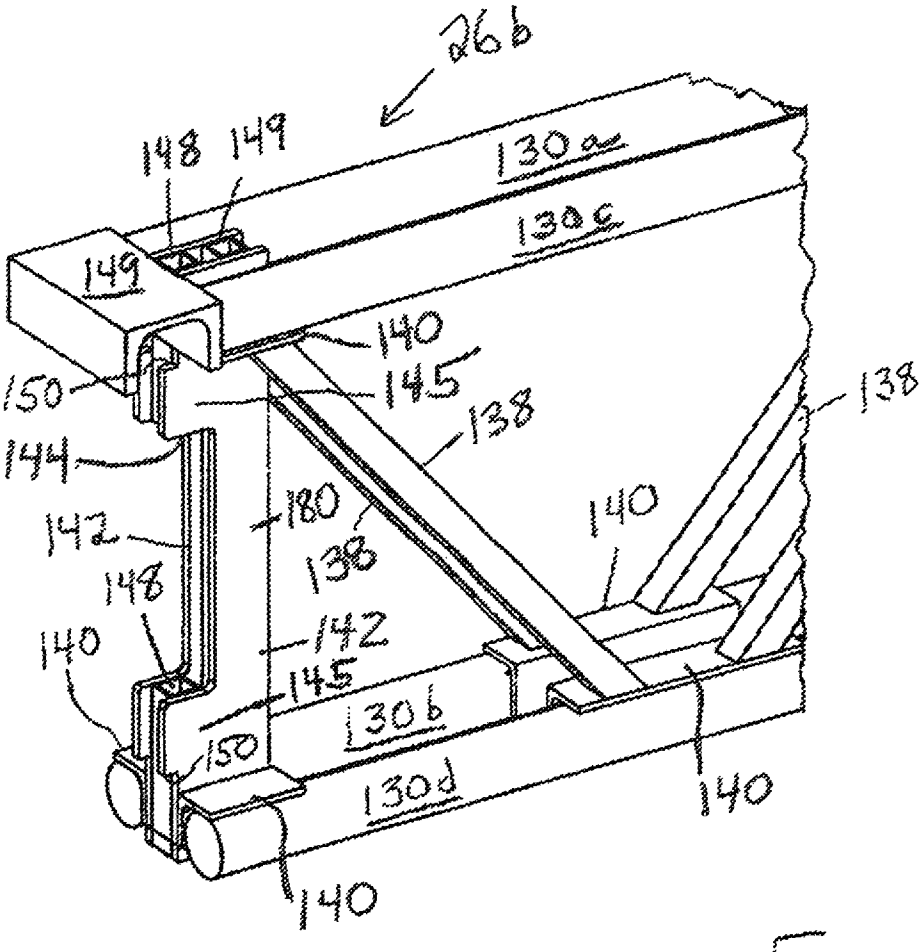
FIG. 15 is an enlarged partial perspective view of the cross beam (second embodiment 24*b* thereof) of FIG. 12.

Referring to FIG. 13, if it is desired to orient a pair of trusses 24' and 24''' in the built platform 20 at an angle to each other, such as the angle illustrated at 23, one set of chords 40*a* and 40*b* of the two trusses 24' and 24''' respectively are connected directly to each other by pin 58*a* and the other set of chords 40*a* and 40*b* of the two trusses 24' and 24''' respectively are connected to an adapter member 27 (or pair of upper and lower adapter members) which has a pair of spaced apertures for alignment with the respective apertures in the trusses 24' and 24''', and two pins 58*b* inserted in the adapter apertures and the truss apertures aligned therewith respectively, thereby to fix the positions of the trusses 24' and 24''' at the angle 23 relative to each other. The angle 23 is related to the distance between the adapter apertures, which is determined in accordance with principles commonly known to those of ordinary skill in the art to which the present invention pertains to achieve the desired angle 23.

The members 70 are spaced longitudinally of and attached to all four chords 40 in a manner, as discussed hereinafter, to allow folding of the truss 24 into a compact shape, as illustrated in FIG. 3, for stowage and transport, and to provide the desired rigidity in the unfolded shape of FIG. 2 when incorporated into the platform 20. For example and without being limiting of the invention, a truss 24 may have a length, illustrated at 72 (FIG. 1), of about 7½ feet and a width as well as height, illustrated at 74 and 75 (FIG. 1), of about 10 inches (the truss 24 thus preferably, but not required, having a generally square cross-section to suitably allow interchangeability of the trusses 24), and 3 members 70 spaced over the length of the truss 24, with one of the members 70 midway of the truss length 72 and each of the other members 70 positioned about ⅔ of the distance from the middle member 70 to the respective end of the truss 24, with the result that for end-to-end co-axially connected trusses 24, the members 70 are spaced apart one from another about 2½ feet. As will be discussed hereinafter, these members 70 are also provided to serve as a means for attachment of the cross beams 26 and may thus be referred to herein and in the claims as connector members. While not every connector member 70 need have attached thereto a cross beam 26, the smaller the distance between members 70, the better the options are for placement of the cross beams 26 as desired or needed (which, for the embodiment being described, desirably allows the option of placement of cross beams 26 as close together as every 2½ feet, if desired). Thus, while there should be at least two spaced connector members 70 for a truss 24 to provide stability, the number and spacing (the spacing may if desired differ from one pair of trusses 24 to another) may vary in accordance with requirements of the particular platform being built or otherwise as desired.

Referring to FIGS. 2, 3, 9, and 10, a preferred connector member or bracket 70*a* has a single vertical plate 170 which has an intermediate arcuately-shaped concave recess, illustrated at 172, on each side thereof. This connector member 70*a* may accordingly be referred to herein and in the claims as a concave connector or concave connector member.

Chords may be connected to the connector members so that they may be swiveled relative to the connector members between the open and closed positions of FIGS. 2 and 3 respectively. In this regard, an angle iron portion may be provided wherein one flat portion thereof may be welded to the respective chord and the other flat portion normal thereto used to provide a swivel connection between this other flat portion and the connector member. Accordingly, in accordance with one embodiment of the present invention, in order to provide the swivel connection, welded or integral therewith or otherwise suitably attached to each of the upper and lower edges of the vertical plate 170 are a pair of horizontally spaced plates 174 which are each swivelly connected to one flat portion 171 of an angle iron portion or bracket 176 by a fastener 92, the other flat portion 173 (normal to flat portion 171) of the angle iron portion 176 in turn welded or otherwise suitably attached to the respective chord 40. In accordance with the present invention, the bracket 176 thus advantageously serves to effect relative rotational movement or swiveling of the chords relative to the connector members 70 for movements of the chords between the folded and unfolded conditions, as discussed in greater detail hereinafter with respect to FIGS. 4 to 7, for storage and transport and for use in a platform respectively.

To the side of the fastener 92 in the bracket 176 is a self-locking mechanism 102 which will be described in greater detail hereinafter.

On each side, inwardly of the swivel fastener 92 and self-locking mechanism 102 as well as inwardly of the respective chords 40 are a pair of upper and lower square or otherwise suitably shaped vertical tubes 178 each of which extends at one end through the respective plate 174 and chamfered at its other end adjacent the recess 172 to conform to the arcuate shape of the recess 172. The passages of the tubes 178 are aligned.

Centrally between the plates 174 in each of the upper and lower edges of the plate 170 is an elongate vertical slot 181 in which is received and welded or otherwise rigidly connected a threaded tube 155 for receiving a threaded stud similar to stud 157 (FIG. 16) for attachment of the decking 30 as will be discussed hereinafter or alternately for receiving an eye-bolt to which a support cable 28 (FIG. 1) may be attached at 21.

Figure 9:
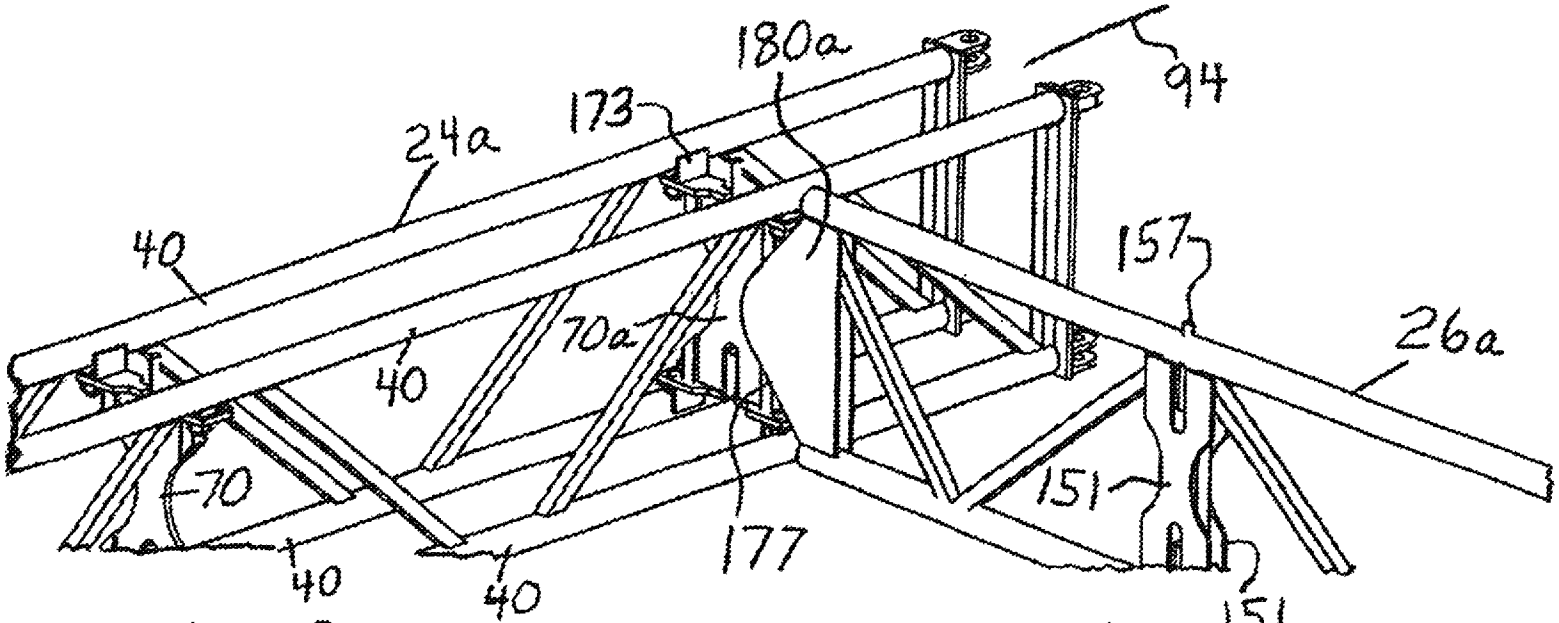
FIGS. 9 and 10 are perspective views, with FIG. 10 enlarged and with chord and brace portions removed in FIG. 10 for purposes of clarity, illustrating the connecting of the cross beam to the frame beam (first embodiments thereof with first embodiments of the connector members 70*a* and 180*a*).
Figure 8:
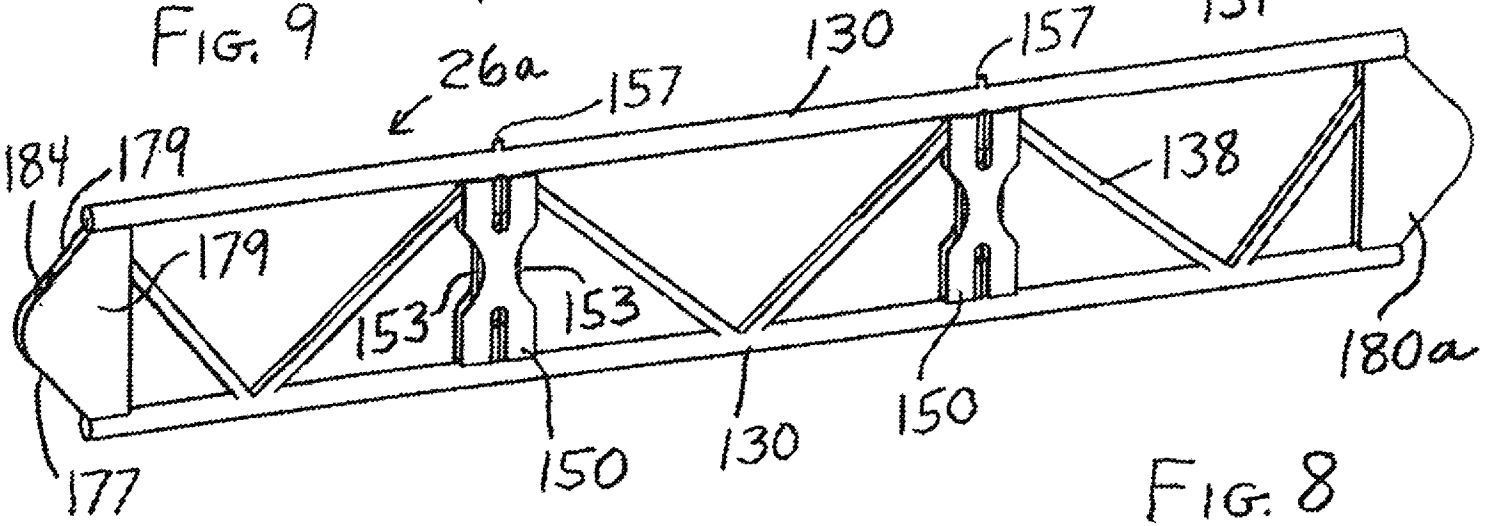
FIG. 8 is a perspective view of one of the cross beams (first embodiment 26*a* thereof) therefor.

Each cross truss 26*a* comprises a single upper chord 40 and a single lower chord 40 rigidly held together by webbing bars 138 and by brackets 150, which are similar to the hereinafter discussed brackets 150 for truss 26*b* and which are spaced intermediate the ends of the truss 26*a*. The plates 151 thereof are welded or otherwise suitably rigidly attached directly to the bottom of the upper chord, along with the end of a webbing bar 138, and top of the lower chord, as seen in FIGS. 8 to 10.

Welded or otherwise suitably rigidly attached directly to the bottom of the upper chord, along with the end of a webbing bar 138, and to the top of the lower chord at each end of the truss 26*a* is a connector member 180*a* whose end edge is formed to have a convexity, illustrated at 177 (FIGS. 8 and 9), to mate with the concave curvature 172 of the connector member 70*a*. The connector member 180*a* thus comprises a pair of parallel plates 179 each having the convex curvature 177 and sandwiching a vertical square (in cross section) tube 184 (FIG. 8).

The ends of the tube 184 are flush with the arcuate edges 177. The convex shape 177 is complementary to the concave shape of the recess or concavity 172 of the connector bracket 70*a* for frame truss 24*a*, and the tube 184 is positioned as a result of the convex shape 177 outwardly of the respective ends of the cross beam chords 40 and is further positioned to easily be positioned between and aligned with the upper and lower square tubes 178 when the protruding curved edge 177 engages and is flush complementarity with the concave recess 172.

Each of the aligned square tubes 178 and 184 is sized to receive (with use of a hammer if necessary) a square (in cross section) pin, illustrated at 84 (FIG. 10), as illustrated at 86, for rigidly connecting the cross truss 26*a* so that it is not rotatable relative to the frame truss 24*a*. Thus, what is important is that the shape of the tubes 178 and 184 and pins 84 be similarly non-circular or such that the truss 26*a* is desirably non-rotatable.

If desired, the pin 84 may be cylindrical or otherwise suitably shaped (with the tubes 178 and 184 being desirably similarly shaped) to thereby desirably reduce the number of types of pins in inventory, i.e., pins 58 and 84 may accordingly be identical.

The pin 84 is provided with an enlarged head 85 to restrain its movement downwardly, and the provision of decking 30 over the pin 84 will advantageously act to prevent inadvertent disengagement of the pin 84 from the tubes 178 and 184. Thus, the pin 84 need not otherwise be secured although it can be if desired.

Each connector member 70*b* (in the alternative embodiment thereof shown in FIGS. 11, 12, 18, and 19) is shown to include two spaced plates 76 (FIG. 11) which have generally rectangular intermediate portions 77 which jut out from the plane, illustrated at 80, defined by the outer limits of the chords 40 on each side of the truss 24, i.e., located out-bound of the respective chords 40.

Hence, this embodiment may be referred to herein and in the claims as the convex connector or convex connector member and will be described in greater detail hereinafter. A concave connector member 70*a* having the recess 172 (FIG. 10) of the first embodiment thereof is considered preferred in that it was found to make installation of the corresponding mating cross beam (which must normally be fitted at each end to a frame beam connector) much easier.

Figure 4:
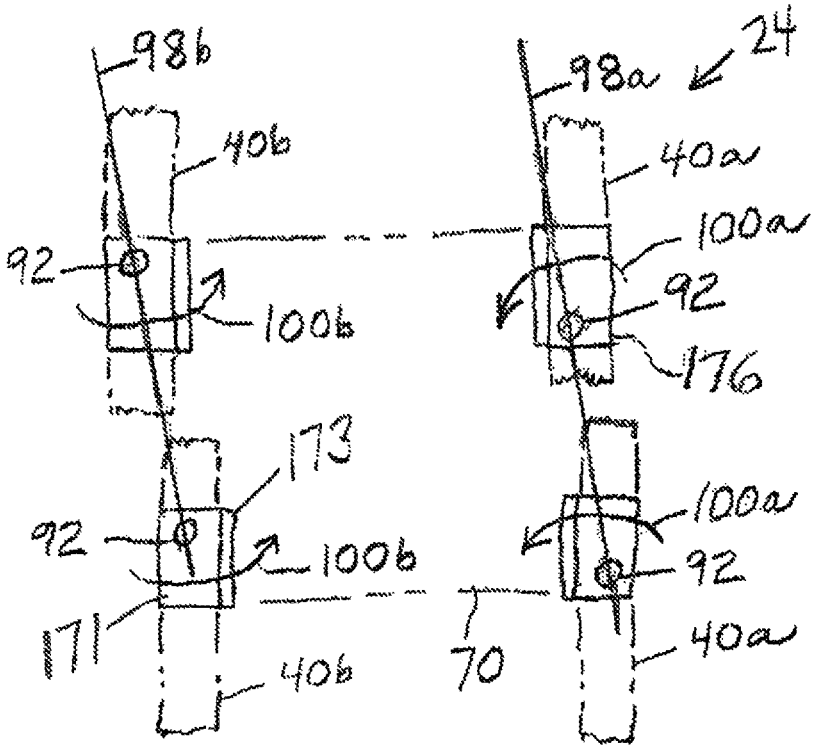
FIG. 4 is a schematic illustration of vertical alignment between upper and lower axes of rotation for folding the frame beam and applies to both the first and a second embodiment (24*a* and 24*b* respectively with connector members 70*a* and 70*b* respectively) of the frame beam.
Figure 5:
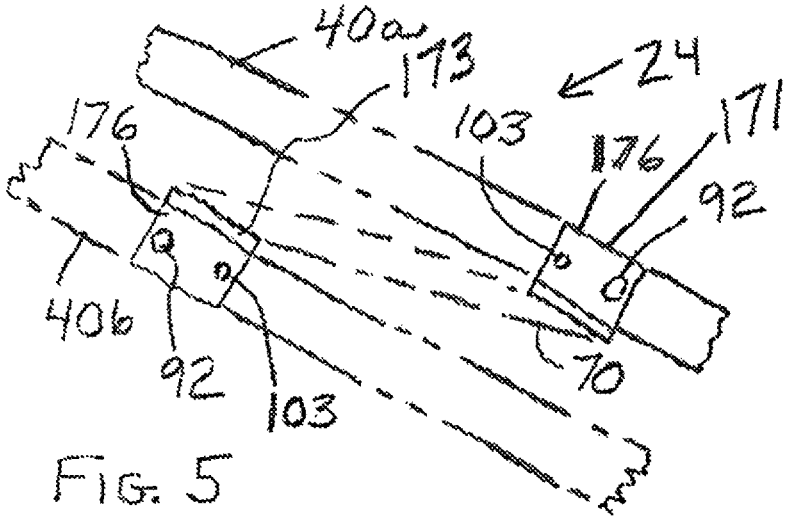
FIG. 5 is a schematic illustration similar to that of FIG. 4, illustrating the rotation of each of vertical pairs of chords of the frame beam about vertical axes into the compact form illustrated and as illustrated in FIG. 3 with the chords spaced close together, only the upper chords illustrated in FIG. 5 for purposes of clarity, it being understood that the lower chords are similarly rotated into the same compact form, and this illustration applies to both the first and a second embodiments (with connector members 70*a* and 70*b* respectively) of the frame beam.

Referring to FIGS. 4 and 5 as well as FIGS. 2, 3, 9, and 10, the fastener 92 attaches the horizontal portion 171 of the angle iron portion 176 to the respective plate 174 in a manner which allows rotation of the horizontal portion 171 in a horizontal plane, illustrated at 94 (FIG. 9) and as illustrated at 100 (FIG. 4). The vertical portion 173 (FIG. 9) of the respective angle iron portion 176 is welded or otherwise suitably rigidly attached to an inner surface portion of the respective chord 40.

Thus, in accordance with the present invention, the angle iron portions 176 are provided as a means for effecting of swiveling movement of the chords 40 relative to the connector members 70, by thusly providing brackets 176 with flat portions 173 welded or otherwise rigidly attached to the chords, whereby flat portions 171 normal to the flat portions 173 provide a base for attaching the respective connector members 70 for the desired swivel movement, illustrated at 100 (FIG. 4), about the axes 98 of the bolts 92. Accordingly, the bolts 92 or other suitable fasteners should be loose enough to allow such rotation yet firm enough to allow the self-locking hereinafter discussed and so that nuts attached to the fasteners do not inadvertently come loose. Suitable such fasteners may be selected using principles commonly known to one of ordinary skill in the art to which the present invention pertains.

While it is contemplated by the present invention that the fastener tightness/looseness be set so that there is no need to adjust them for folding and unfolding of the trusses 24, if desired, the bolts 92 may be tightened after such self-locking then loosened again for folding of the trusses 24 for storage/stowage and transport, but this may not be required if the fasteners are set to a looseness/tightness that both allows the desired rotation and suitable allows the self-locking.

In order for the pair of chords 40*a* to be suitably swiveled in unison relative to the respective connector members 70, i.e., about the bolt axes, in accordance with the present invention, it was found to be very important that the bolts 92 for the pair of chords 40*a* be in alignment, i.e., that the respective vertically upper and lower bolts 92 have the same vertical axis 98*a* (FIG. 4). Likewise, in order for the pair of chords 40*b* to be suitably rotatable or swiveled in unison relative to the respective connector members 70, it is important that the bolts 92 for the pair of chords 40*b* be in alignment, i.e., that the respective vertically upper and lower bolts 92 have the same vertical axis 98*b* (FIG. 4). The angle iron portions 176 and accordingly the chords 40*a* rigidly attached thereto are rotatable, as illustrated at 100*a*, about the vertical axis 98*a*, i.e., the aligned axes of bolts 92 (while not drawn to appear thusly for purposes of ease of illustration in FIG. 4, it should be understood that one of the bolts 92 should be considered to be vertically in alignment with or directly above the other, i.e., have the same vertical axis 98*a* for the pair of chords 40*a*).

Independently and at the same time, the angle iron portions 176 and accordingly the chords 40*b* rigidly attached thereto are rotatable, as illustrated at 100*b*, about the vertical axis 98*b*, i.e., the axes of bolts 92 (it again being understood that one of the bolts 92 is vertically in alignment with or directly above the other). Thus, the vertically aligned bolts 92 for each side (i.e., each pair of chords 40*a* and 40*b*) may be said to provide a hinge effect, wherein it is important that each pair of bolts be vertically aligned, i.e., have the same vertical axis 98*a* for one side and 98*b* for the other side. Such rotation is provided to advantageously effect swiveling movement of the chord pairs 40*a* and 40*b* into (and out of) a relatively close relationship, as illustrated in FIGS. 3 and 5, to achieve the desired compactness for stowage and transport.

As seen in FIG. 4, the rotation 100*a* for the pair of chords 40*a* is shown to be counter-clockwise while the rotation 100*b* for the pair of chords 40*b* is shown to be counter-clockwise, i.e., the rotation for one pair of chords is opposite to the rotation for the other pair of chords. To achieve such opposite rotation, the bolts 92 for one pair of chords 40*a* are positioned toward one end of the respective angle iron portions 176 to achieve the counter-clockwise movement while the bolts 92 for the other pair of chords 40*b* are positioned toward the other end of the respective angle iron portions 176 to achieve the clockwise movement.

As previously discussed, adjacent one edge of each bracket 176 is a fastener 92 about which the bracket 176 (with a corresponding chord rigidly attached) rotates as illustrated at 100 to fold the truss 24 into the compact form illustrated in FIGS. 3 and 5 for stowage and transport. When it is desired to use a truss 24 for connecting to another truss 24 for erecting a platform 20, it is considered desirable to snap or self-lock the truss 24 back into the position illustrated in FIGS. 1 and 2 for such use.

Figure 6:
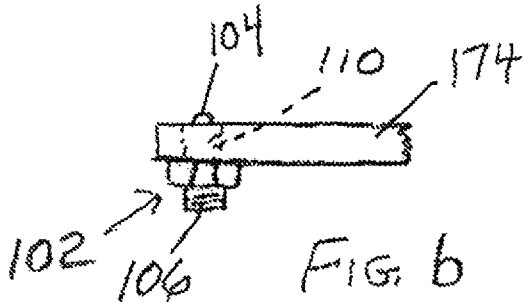
FIG. 6 is a schematic illustration of a mechanism for self-locking of the positions of the chords into a position for use of the frame beam for erecting a platform and is applicable to both the first and a second embodiments (with connector members 70*a* and 70*b* respectively) of the frame beam.
Figure 7:
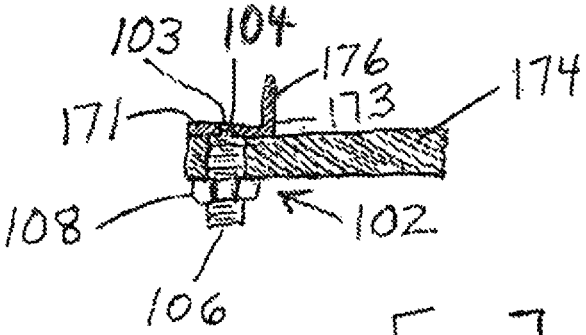
FIG. 7 is a schematic illustration similar to that of FIG. 6 illustrating the use of the mechanism for self-locking of the positions of the chords.

The self-locking mechanism 102 is provided to snap or self-lock the truss 24 back in such a position. In accordance therewith, an aperture, illustrated at 103 in FIGS. 5 and 7, is provided in each bracket 176 adjacent the edge thereof which is opposite the edge which the respective fastener 92 is adjacent. Referring to FIGS. 6 and 7, a ball bearing or other suitably domed member 104 (which is suitably beveled so that it does not act as a stop) is suitably positioned to suitably protrude above the plate 174 by suitable means such as, for example, a stud 106 tightly received in an aperture, illustrated at 110, in plate 174, with a suitable lock nut 108, wherein the domed member is suitably positioned on the end of the stud 106 to slightly protrude a desirable distance above plate 174 to achieve the desired self-locking, in accordance with principles commonly known to those of ordinary skill in the art to which this invention pertains.

In order to unfold a folded truss 24 (as in FIGS. 3 and 5) for erection into a platform 20, the brackets 176 and accordingly the chords 40 rigidly attached thereto are rotated to bring them from the position in FIGS. 3 and 5 back into the position of FIG. 2 for use, at which time the domed members 104 engage the apertures 103 respectively to self-lock the brackets into the position illustrated in FIG. 7, i.e., offering resistance to the removal of the domed members 104 from the apertures respectively. This amount of resistance is desirably adjusted so that the positions of the brackets 176 are maintained during use of the trusses 24 to erect a platform 20, and with some moderate force as may be predetermined this resistance can be overcome to once again fold the trusses for stowage and transport. The amount of this resistance can be selected/adjusted (including positioning of the domed member, i.e., the selection of how far above the plate 174 it protrudes, for example, about 1/16 to 1/8 inch) using principles commonly known to those of ordinary skill in the art to which the present invention pertains. It should be understood that other means for alternatively or additionally locking the truss 24 in the unfolded condition may be provided, such as described hereinafter with respect to plate 60 (FIG. 11).

While it is considered to be desirable, no locking feature (such as the plate 60 or as described above with respect to FIGS. 6 and 7) need be provided, reliance being had on the interconnection to other trusses 24 and 26 and to flooring 30 to achieve the needed rigidity. Thus, the self-locking feature 102 is not contained in the embodiment illustrated in FIG. 11, and the fasteners 92 in the embodiment of FIG. 11 (while still aligned vertically) are illustrated to be centrally located in the brackets 176 thereof. Therefore, while preferred and may be added to the embodiment illustrated in FIG. 11, the self-locking and/or more positive locking features are not considered critical to the present invention.

In order to insure rigidity of the truss 24 during erection and use in the platform 20 or other structure (against, for example, inadvertent failure of the self-locking feature), in accordance with a preferred embodiment of the present invention, a plate 60 (FIGS. 11 and 12) is provided at one or both ends of the truss 24. While not shown in the concave connector embodiment of the frame truss 24*a* of FIGS. 8 and 10, a similar plate 60 similarly attached as discussed hereinafter, may optionally be provided in the embodiment thereof and is preferred.

Figure 12:
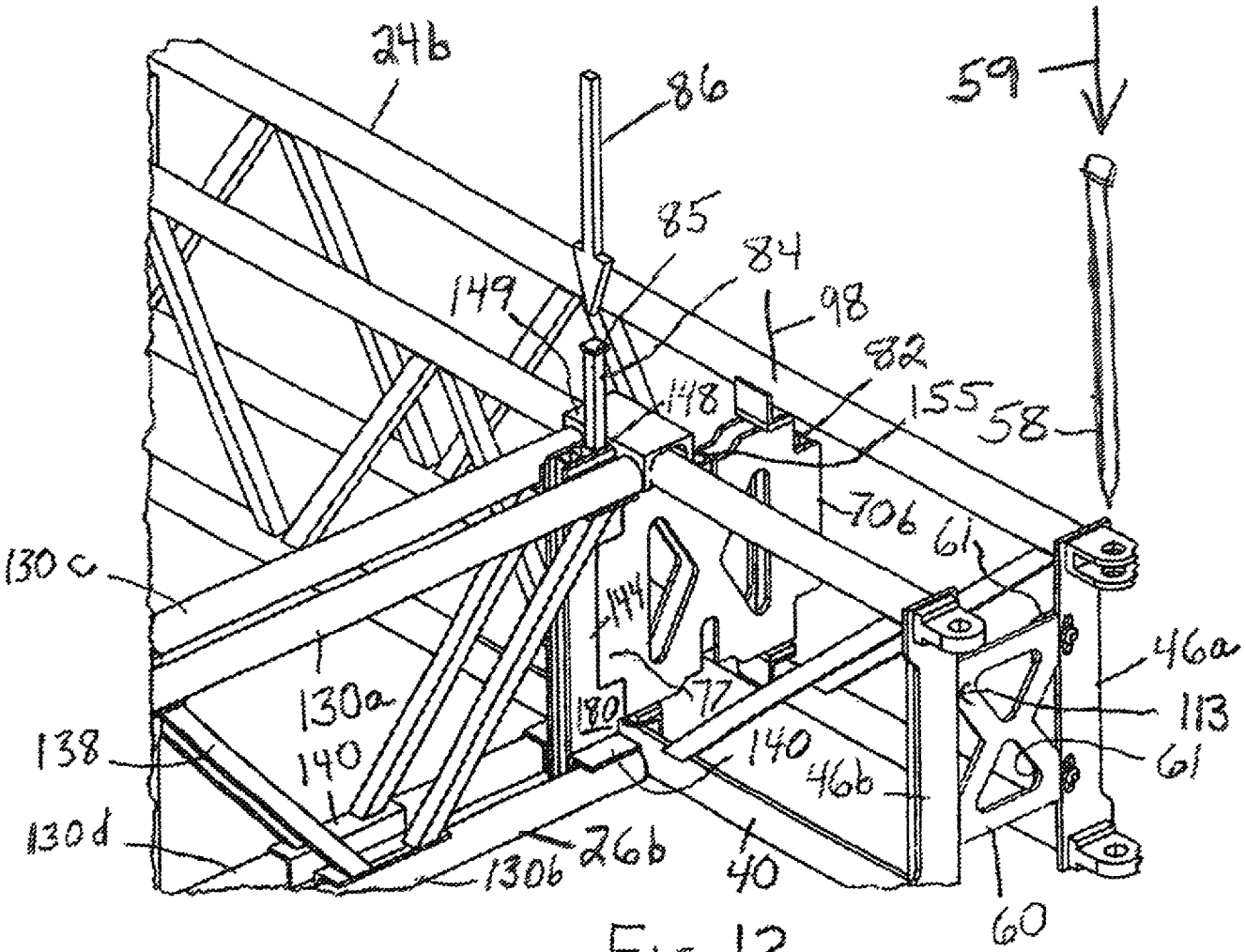
FIG. 12 is a partial perspective view of one of the cross beams in accordance with the second embodiment 26*b* thereof and illustrating its attachment to the frame beam (second embodiment 24*b* thereof having the convex embodiment of the connector member 70*b*) of FIG. 11.

The plate 60 is suitably hinged to the inner edge of a plate 46 (in FIG. 12, shown as plate 46*b*) at 113 so that it may hingedly rotate inwardly to a position where it lies between the chord pairs 41*a* and 41*b* when the truss 24 is in the folded condition during storage and transport. For example, upper and lower plates (not shown) may be welded or otherwise suitably rigidly attached to the back of plate 60 to extend outwardly beyond the respective edges respectively of plate 60 and hingedly engage the respective member 46*a* (with a suitable hinge, not shown, which is suitably provided with a gap or gaps to be sufficiently loose to allow suitable vertical movement for the purpose as discussed hereinafter), whereby the respective edges (upper and lower) of plate 60 at 114 may desirably be flush with the corresponding inner edge of the respective plate 46 when the truss 24 is in the unfolded condition of FIGS. 11 and 12. The hinged plate 60 is tucked suitably between the chord pairs 41*a* and 41*b* so that it is secured with nowhere to go when the truss 24 is folded shut or closed into the position for storage or transport. The plates 60 as well as members 70 have lightening cut-outs 118. On the opposite side of the plate 60, similar upper and lower plates, illustrated at 61, may be welded or otherwise suitably rigidly attached to the back of plate 60 to extend outwardly beyond the respective edges respectively of plate 60.

Welded or otherwise suitably rigidly connected to the outer faces of plates 61 are a pair of vertically spaced projections 120 each terminating in an enlarged portion or button 122 (or in which the button 122 is otherwise suitably adjacent the end thereof), the button 122 being integral with the respective projection 120 or suitably rigidly attached thereto. The spacing between the button 122 and the respective plate 61 is approximately equal to the combined thickness of the respective plates 46 and 112. Vertically spaced in the respective plate (46*b* in FIG. 11) and in the respective plate 112 and adjacent the inner vertical edges thereof are a pair of vertically oblong aligned openings or slots 124 which are too narrow over a substantial portion or portions 128 of their heights to receive the buttons 122 but which are wide enough over their height to receive the narrower projections 120 on which the enlarged buttons 122 are contained. Each opening 124 has an enlarged portion 126 sized for receiving the respective button 122. The enlarged portion 126 is preferably intermediate the vertically upper and lower ends of the opening 124, thus providing narrow slot portions 128 both above and below respectively the enlarged slot portion 126. Thus, when the truss 24 is unfolded for erection of a platform 20 and self-locked as illustrated in FIG. 7 (if it has such a self-locking mechanism 102), it may be easily and quickly more rigidly so disposed by swinging the plate 60 (after it is freed of any restraints, if any) in a direction opposite the direction 116 so that the buttons 122 are received in and clear the enlarged intermediate opening portions 126 respectively, after which the plate 60 may be pushed downwardly (hammered downwardly if necessary), as allowed by the above-described gap or gaps providing some play or looseness in the hinge which allow such vertical movement, to position the buttons 122 along lower narrow portions 128 of the openings 124 respectively to thereby rigidly interconnect the chord pairs 41*a* and 41*b* thus rigidly locking the truss 24 in the unfolded position for erecting a platform. It should be noted that the side edges of the plate 60 in this unfolded condition are accordingly disposed flush with the respective edges of plates 46 thereby aiding in preventing inadvertent folding of the truss 24. When it is time to fold the truss 24 for storage and transport, the plate 60 may just as easily be unattached to the respective plate 46*b* by pushing (with use of a hammer if necessary) the plate 60 vertically (with the truss 24 turned vertically upside-down as desirable) so that the buttons 122 are moved into align with the enlarged slot portions 126 respectively and then disengaged from the slots 124 respectively and the plate 60 swung away from the respective plate 46*b*, as illustrated at 116. The position of the enlarged slot portion 122 intermediate the respective slot 124 desirably allows interchangeability between upper and lower sides for attachment of the plate 60, i.e., the truss 24 as seen in FIGS. 11 and 12 may be turned upside down for attachment/detachment of the plate 60 and, either way, the plate 60 can be driven or pushed downwardly to achieve its rigid attachment or detachment.

It should be understood that other suitable means for providing such a rigid detachable attachment other than by plate 60 may be provided, for example, the plates 46*a* and 46*b* may each be double plated, providing slots along their resulting vertical inner edges for vertically receiving a suitable plate. Such other means are meant to come within the scope of the present invention as defined by the claims.

However, it should also be understood that the truss may not contain such a mechanism at all, with reliance on the self-locking mechanism 102 of FIGS. 6 and 7 and/or by the locking afforded by the interconnected trusses and laid decking to provide the desired or needed truss rigidity.

Referring to the convex connector embodiment of FIGS. 11, 12, 18, and 19, a vertical square (in cross-section) tube 82 is received between each pair of outer portions 77 of spaced plates 76 and is welded or otherwise suitably attached to the respective pair of plates 76. Each square tube 82 is sized to receive (with use of a hammer if necessary) a square (in cross section) pin, illustrated at 84 (FIG. 12), as illustrated at 86, for rigidly connecting a cross truss 26 so that it is not rotatable, similarly as discussed for the concave connector. Thus, what is important is that the shape of the tubes 82 and pins 84 be similarly non-circular or such that the truss 26 is desirably non-rotatable relative to the truss 24 (unless it is desired that the truss 26 in fact be rotatable for the purposes of a particular platform).

Welded or otherwise suitably rigidly attached to the respective plates 76 to span the respective plates 76 and positioned to underlie the respective chord 40 is a plate 88. The flat horizontal portion 171 of an angle iron (L-shaped) portion 176 or other suitably shaped bracket is attached to the respective plate 88 by suitable means such as, for example, a bolt 92.

A threaded tube 155 for a stud for attaching the decking 30 or an eye-bolt for attaching a support cable is provided in the upper cut-out 181 (not shown in FIG. 11) and may also be provided in the lower cut-out 181.

Referring to FIGS. 12 and 14 to 17, in the second embodiment thereof (which may be called a "double-chord cross truss" as compared to the "single-chord cross-truss" first embodiment of FIGS. 8 to 10), the cross truss 26*b* comprises two upper chords 130*a* and 130*c* and two lower chords 130*b* and 130*d*, all being identical tubular chords similar to chords 40 but perhaps of a different length as desired. For example, each chord 130 (which extends over the length of the truss 26*b*) has a length, illustrated at 132 in FIG. 17, of approximately 5½ feet. For example, truss 26*b* may have a height, illustrated at 134 in FIG. 16, of approximately 10 inches and a width, illustrated at 136 in FIG. 17, of approximately 4 inches.

Each pair of vertically spaced chords (the first pair being 130*a* and 130*b* and the second pair being 130*c* and 130*d*) are rigidly attached by diagonal elongate struts or bars 138 welded or otherwise suitably rigidly attached to horizontal portions of angle iron portions 140 (as appropriate) which are in turn welded or otherwise suitably rigidly attached to the respective chords 130. At each end, a pair of spaced plates 142 comprising a connector member 180*b* to mate with connector member 70*b* extend vertically between the respective end portions of the chords 130 and are also welded or otherwise suitably rigidly attached to vertical portions of respective ones of the angle iron portions 140 respectively. The intermediate portions of the plates 142 are generally rectangularly recessed, as indicated at 144, each to receive or mate with the respective protruding intermediate rectangular portion 77 of the convex connector member 70*b* of frame truss 24*b*, as seen in FIG. 12, leaving portions 145 above and below the recessed intermediate portion 144.

Square tubes 148 are sandwiched between and welded or otherwise suitably rigidly attached to the upper plate portions 145 and to the lower plate portions 145. The square tubes 148 are sized similarly as square tube 82 (FIG. 11) and are positioned so that, for attachment of the truss 26*b* to truss 24*b*, the square tubes 82 and 148 may be aligned for insertion of the square pin 84 (FIG. 12). The upper and lower outer edges of the plates 142 are suitably notched, as illustrated at 146 in FIG. 16, to suitably provide clearance of the respective lower frame beam chord 40, as seen in FIG. 12. A similar (in cross section) square tube 152 (spaced inwardly from upper and lower square tubes 148) or more than one thereof or other suitable strengthening member or members is disposed between the plates 142 (including between the intermediate portions thereof) and extends over the entire height of the plates 142 and is similarly welded or otherwise suitably rigidly attached thereto to provide suitable rigidity and strength. An inverted generally U-shaped member 149 is welded or otherwise suitably rigidly attached at each end of the truss 26*b* to the ends of the upper chords 130*a* and 130*c* for the purpose of overhanging the respective chord 40 of the respective truss 24*b* to make it easier to hold the truss 26*b* in position for insertion of the pin 84 as well as to provide additional strength and stability to the platform 20.

Spaced between the ends of the truss 26*b* are one or more brackets or cross-braces 150 comprising a pair of plates 151 (which have intermediate cut-outs, illustrated at 153, on each side thereof) which sandwich there between a pair of longitudinally spaced square (in cross section) tubes 154, similar to tubes 152, all welded or otherwise suitably rigidly connected together and to the chords 130 respectively for strengthening of the truss 26. For example, truss 26*b* is shown to have two such brackets 150 equally spaced over its length.

The brackets 150 include a threaded tube 155 welded or otherwise suitably rigidly attached in cut-outs 159 in and between the upper as well as in and between the lower end portions of the plates 151 (between the square tubes 154) and in which is threadedly receivable a stud 157.

Studs 157 (whether received in threaded tubes 155 or otherwise provided in any of the embodiments of the present invention) are receivable in a hole, illustrated at 160 (FIG. 1), in the decking 30 for the purposes of securing the decking and clipped such as by a plate having a hole in which the stud is received and a nut applied or by a suitably sized nut applied to the stud. The hole 160 may be oblong so that it may be easier to receive the studs 157 in the decking, or it may be circular with a diameter just sufficient to receive the stud 157 so as to provide a more rigid fit, or it may be otherwise suitably shaped. Alternately and as needed, the stud 157 may be removed and replaced with an eye-bolt to which a support cable 28 may be suitably attached.

In order to position a cross truss 26*b* for attachment to the respective connector brackets 70*b* at its ends respectively, the truss 26*b* is positioned with the overhangs 149 received on the respective upper chords 40 respectively, then easily slid along the chords so that its connector members 180 engage the mating convex connector members 70*b* with the square tubes 82 and 148 aligned and the square pin 84, with enlarged head 85, inserted therein. The thereafter securing of the decking 30 in place over the pin 84 is provided to securely hold the pin 84 in place.

In order to position a cross truss 26*a* (first embodiment) for attachment of its connector members to the respective mating concave connector members 70 at its ends respectively, the truss 26*a* is held to the sides of the brackets 70 then moved sideways to effect engagement of the convex protruding portions at the ends respectively with the respective recesses 172 and with the square tubes 178 and 184 in alignment. If desired, the truss 26*a* may be provided at each end with an overhang, similar to overhang 149, to make such positioning easier. The square pin 84, with enlarged head 85, is then inserted in the aligned tubes 178 and 184. The thereafter securing of the decking 30 in place over the pin 84 is provided to securely hold the pin 84 in place.

Referring to FIGS. 20 to 23, after an initial platform portion suitable for workers to stand on is prepared and dropped into place, the remainder of the platform 20 may be quickly and easily erected as follows.

As illustrated in FIG. 20, a cross truss 26 may, as needed to provide adequate support of the workers, be attached to the frame trusses 24 adjacent the ends thereof by attachment to the connectors 70 closest to the end. A section of the decking 30 is then applied (temporarily, if appropriate) to overlap each of the frame trusses 24 as well as the adjacent cross truss 26 to provide stability as well as overlap adjacent sections of decking 30. The decking 30 is secured in place by suitably positioned studs 157 received in decking apertures 160 and held by nuts applied to the studs 157 or by plates in apertures of which the studs are received and nuts applied or by other suitable means. The studs 157 may be positioned to extend upwardly from upper chords, as illustrated in FIGS. 8 and 9, or positioned to be threadedly received in threaded tubes 155 of connector members, as illustrated in FIGS. 2, 3, 10, and 12 (not illustrated but could be applied in FIG. 11), or otherwise suitably positioned. As needed, the studs may be replaced by eye-bolts to which the cables 28 are attached for supporting the platform 20, or the cables 28 may be otherwise suitably attached.

With the previously discussed light weight of the frame beams 24 as well as the cross beams 26, a worker or couple of workers can easily hold the first frame truss 24 to be attached generally parallel and close to the edge of the decking 30 (a position of the first frame truss 24 which is provided so that it can be easily held for attachment). The respective apertures 52 and 56 on one side 44 of each of the trusses 24 being attached are aligned and a cylindrical pin 58*a* inserted in the aligned apertures. This allows rotation easily of the first frame truss 24 being attached, and the first frame truss 24 is then rotated, as illustrated at 190, about the pin 58*a* to the position illustrated in FIG. 21.

Figure 21:
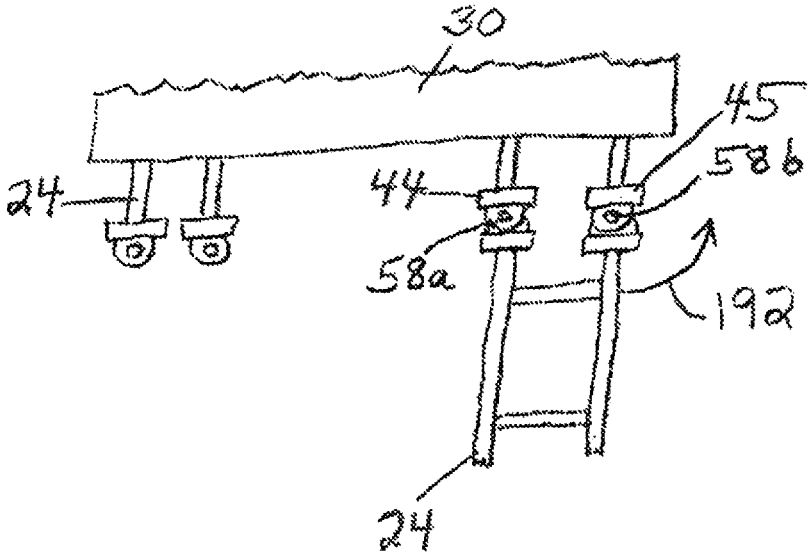

As illustrated in FIG. 21, the respective apertures 52 and 56 on the other side 45 of each of the trusses 24 are aligned and another cylindrical pin 58*b* is inserted in the aligned apertures to achieve the desired end-to-end relationship of the now rigidly attached frame trusses 24. If the frame trusses 24 are sufficiently short, i.e., substantially shorter than the cross trusses 26, then a second frame truss 24 may be similarly rigidly attached on the other side of the edge of the decking 30 to lie parallel and longitudinally aligned with the first frame truss 24, as illustrated in FIG. 23, and cross trusses and decking attached as previously discussed thereby providing an additional segment of the platform 20. However, if the frame trusses 24 are longer than the distance between them or longer than the cross trusses 26, as illustrated in FIG. 20, then the attached first frame truss 24 must be moved out of the way to allow the attachment of the second frame truss 24 to the other side. In order to do this, the first pin 58*a* is now removed, allowing rotation of the attached truss 24 about pin 58*b*, as illustrated at 192, to the position thereof illustrated in FIG. 22.

Figure 22:
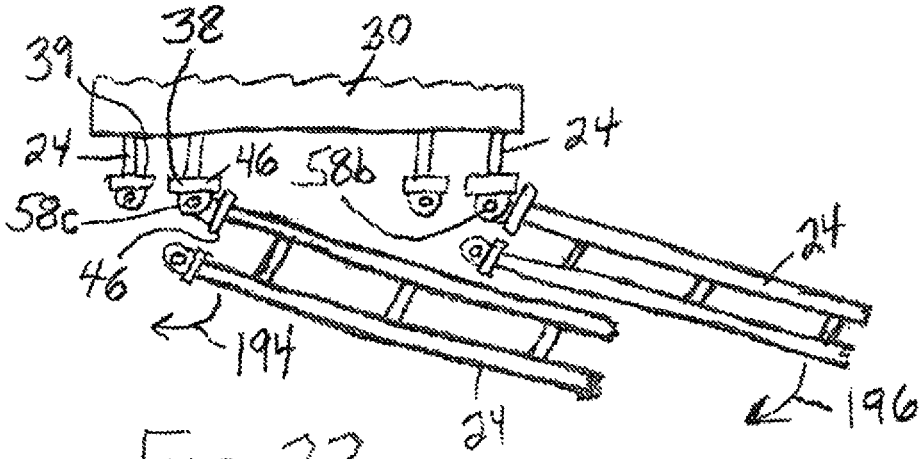
Figure 23:
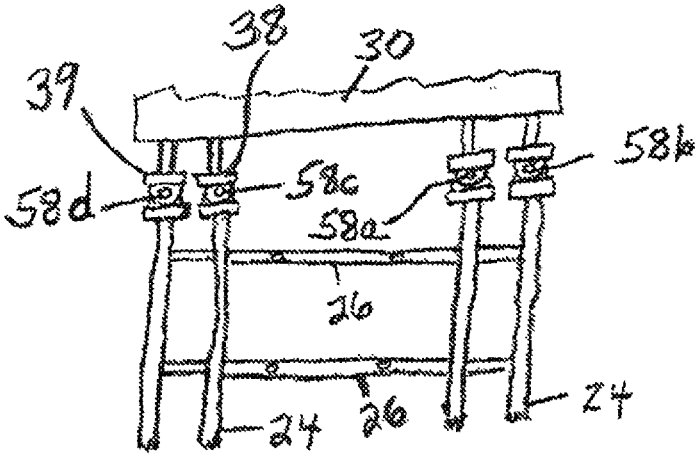

Referring to FIG. 22, the second frame truss 24 to be attached may, similarly as done for the first frame truss 24, be easily held generally parallel and close to the edge of the decking 30, as now allowed by the first frame truss 24 having been rotated out of the way. The respective apertures 52 and 56 on one side 38 of each of the trusses 24 being attached are aligned and a third cylindrical pin 58*c* inserted in the aligned apertures. This allows rotation easily of this second frame truss 24 being attached, and this second frame truss 24 is then rotated, as illustrated at 194, about the pin 58*c* to the position illustrated in FIG. 23.

As illustrated in FIG. 23, the respective apertures 52 and 56 on the other side 46 of each of the second frame truss 24 and the truss 24 to which it is being attached are aligned and a fourth cylindrical pin 58*d* is inserted in the aligned apertures to achieve the desired rigid end-to-end relationship of the second frame truss 24 and the frame truss 24 to which it is now attached. The first frame truss 24 may now be similarly rigidly attached to lie parallel to the second frame truss 24 and longitudinally aligned with the frame truss 24 to which it is accordingly attached, as illustrated in FIG. 23, by rotating the first frame truss 24, as illustrated at 196, aligning the respective apertures and re-inserting the pin 58*a* into the respective apertures 52 and 56, resulting in the new first and second frame trusses 24 having been laid to the platform section of FIG. 20.

Additional cross trusses 26 and decking 30 may now be attached as previously discussed thereby providing an additional segment of the platform 20.

Additional decking sections may of course be similarly laid. As necessary, decking 30 may be temporarily laid so that one of its edges is adjacent the location where a cross truss 26 is to be attached, to provide space for the workers adjacent where they are working to attach the cross truss 26.

Following similar principles as discussed above with respect to FIGS. 20 to 23, variations of the frame may be laid, such as illustrated generally at 200 in FIG. 24, wherein four frame trusses 24 are attached at a common juncture 202. If desired, the direction taken by the laid frame trusses may be changed by use of the adapters 27 (FIG. 13), wherein the angle 23 for each adapter would desirably be the same in order to maintain a parallel relationship between frame trusses 24. It is of course to be understood that the trusses 24 and 26 may be laid in other ways which incorporate the principles of the present invention, and such other ways are meant to come within the present invention as defined by the appended claims.

As is apparent from the at least two different embodiments (concave and convex) of the connector member disclosed herein for the frame truss 24 and the mating embodiments of the connector member for the cross truss 26, and the at least two different embodiments (single-chord and double-chord) of the cross truss 26, the present invention may take various additional forms. For example, either of the pairs of mating connector members may be adapted, in accordance with principles commonly known to those of ordinary skill in the art to which the present invention pertains, for use with either of the respective cross trusses disclosed herein. Thus, for example, a double-chord cross truss (i.e., having two upper chords and two lower chords) may be provided with a connector member which mates with a concave connector member for use where additional strength of the cross trusses is desired.

The alignable eyelets 52 and 56 are provided to allow the quad-chord trusses 24 to be releasable secured end-to-end. Likewise, the mating connector members 70 and 180 for the quad-chord trusses 24 and the cross beams 26 respectively are provided to allow the cross beams 26 to be releasable secured to the quad-chord trusses 24. Thus, the releasable securing of the quad-chord trusses 24 to each other and to the cross beams 26 and the resulting non-permanent connections of the quad-chord trusses 24 and cross beams 26 is provided so that the platform 20 can be quickly and easily erected and dismantled over and over again.

It should thus be understood that, while the present invention has been described in detail herein, the invention can be embodied otherwise without departing from the principles thereof, and such other embodiments are meant to come within the scope of the present invention as defined by the appended claims.

What is claimed is:

1. An erected platform comprising a plurality of lines of quad-chord trusses each said quad-chord truss comprising four chords all spaced from one another, wherein said four chords includes two upper chords disposed at a first height and two lower chords disposed at a second height, each of said four chords having an eyelet at each end which is alignable with said eyelet at an end of a respective said chord of an other of the quad-chord trusses, a plurality of pins releasably securing said alignable eyelets respectively wherein at least a pair of said quad-chord trusses in each of said lines are attached end-to-end, each of said quad-chord trusses having at least one first connector member intermediate its ends, said first connector member including at least one first plate attached to and extending vertically between both said upper chords and both said lower chords and further including at least one first vertically extending channel member which is connected to said first plate and which has a first vertically extending channel therein, at least two cross beams each having an upper chord disposed at said first height and a lower chord disposed at said second height and a pair of second connector members on ends respectively thereof, wherein said second connector members mate with and are releasably secured to said first connector member on a respective one of said quad-chord trusses in one of said lines and said first connector member on a respective one of said quad-chord trusses in an other of said lines respectively, wherein each of said second connector members includes at least one second plate attached to and extending vertically between said upper chord and said lower chord of each of said cross beams and further includes at least one second vertically extending channel member connected thereto and having a second vertically extending channel therein, wherein said first and second vertically extending channels are aligned, an other pin is received in said aligned first and second vertically extending channels, and the erected platform further comprising decking overlying and attached to said quad-chord trusses and said cross beams.

2. An erected platform according to claim 1 wherein at least one of said quad-chord trusses comprises a first pair and a second pair of said chords, first webbing rigidly attaching said chords of said first pair, second webbing rigidly attaching said chords of said second pair, at least two of said first connector member spaced longitudinally of said chords and interconnecting said first pair of chords with said second pair of chords in a manner to effect folding of said chords between a first position wherein said first pair of chords is spread apart from said second pair of chords for use in the platform and a second position wherein said first pair of chords is folded next to said second pair of chords for transport and storage thereof.

3. An erected platform according to claim 1 wherein said decking comprises sheets of overlapping corrugated sheet metal.

4. An erected platform according to claim 1 wherein said at least one first plate is attached to and extends vertically between both of said upper chords and both of said lower chords and includes at least one of said first vertically extending channel member on one side edge of said first plate and at least one of said first vertically extending channel member on an other side edge of said first plate.

5. An erected platform according to claim 1 wherein at least one of side edges of said first plate has a central portion which has a concave curvature and further has upper and lower portions, wherein said at least one first vertically extending channel member includes two of said first vertically extending channel member which are connected to said upper and lower portions respectively of said at least one of side edges of said first plate, and wherein a side edge of said second plate has a convex curvature which mates with said concave curvature.

6. An erected platform according to claim 1 wherein at least one of side edges of said first plate has upper and lower portions and further has a central portion which protrudes relative to said upper and lower portions and to which is connected said at least one first vertically extending channel member, wherein said second plate has a side edge which has a central portion and which further has upper and lower portions which protrude relative to said central portion of said side edge of said second plate, and wherein said at least one second vertically extending channel member includes two of said second vertically extending channel member which are connected to said upper and lower portions respectively of said side edge of said second plate.

7. An erected platform according to claim 2 wherein each of said first connector members comprises a bracket rigidly attached to each of said chords and a fastener swivelly attaching said respective first connector member to said respective bracket, wherein said fasteners for each of said pairs of chords are aligned so that both of said first pair of chords have a same swivelling axis and so that both of said second pair of chords have a same swiveling axis.

8. An erected platform according to claim 7 further comprising means for locking said at least one of said quad-chord trusses in said first position, wherein said locking means comprises for at least one of said first connector members a protruding member on one of said respective bracket and said at least one first connector member and an aperture on the other of said respective bracket and said at least one first connector member wherein said aperture is engageable by said protruding member whereby force is required for disengaging said protruding member from said aperture.

9. An erected platform according to claim 2 wherein each of said at least two of said first connector member further comprises means for locking said at least one of said quad-chord trusses in said first position.

10. An erected platform according to claim 1 wherein said first and second vertically extending channels have similar non circular shapes, and wherein said other pin is similarly non-circular whereby the cross beam is non-rotatable about said other pin.

11. An erected platform according to claim 1 wherein the platform is erected by the steps of:

providing an existing platform portion which has a portion of the decking laid on existing parallel ones of the quad-chord trusses wherein an edge of the decking portion is adjacent ends of two existing parallel ones of the quad-chord trusses;

positioning a first other one of the quad-chord trusses generally adjacent the edge of the decking portion;

aligning apertures on one side of each of the ends to be connected of one of the existing quad-chord trusses and the first other quad-chord truss;

inserting a first of the plurality of pins in the aligned apertures on the one sides of the one existing quad-chord truss and the first other quad-chord truss;

swinging the first other quad-chord truss about the first pin to a position for connecting of other sides of the ends to be connected of the first other quad-chord truss to the one existing quad-chord truss;

aligning the apertures on the other side of each of the ends to be connected of the one existing quad-chord truss and the first other quad-chord truss; and inserting a second of the plurality of pins in the aligned apertures on the other sides of the one existing quad-chord truss and the first other quad-chord truss.

12. An erected platform according to claim 11 wherein the steps further comprise selecting the decking to be corrugated sheet metal decking and further comprising overlapping sections of the decking with adjacent sections of the decking.

13. An erected platform according to claim 11 wherein the steps further comprise:

removing the first pin from the aligned apertures on the one sides of the first other quad-chord truss and the one existing quad-chord truss;

swinging the first other quad-chord truss about the second pin away from the other of the existing quad-chord trusses;

positioning a second other quad-chord truss generally adjacent the edge of the decking portion;

aligning eyelets on one side of each of the ends to be connected of the other of the existing quad-chord trusses and the second other quad-chord truss;

inserting a third of the plurality of pins in the aligned apertures on the one sides of the other existing quad-chord truss and the second other quad-chord truss;

swinging the second other quad-chord truss about the third pin to a position for connecting of the second other quad-chord truss to the other existing quad-chord truss;

aligning apertures on the other side of each of the ends to be connected of the other existing quad-chord truss and the second other quad-chord truss;

inserting a fourth of the plurality of pins in the aligned apertures on the other sides of the other existing quad-chord truss and the second other quad-chord truss;

swinging the first other quad-chord truss about the second pin to a position for connecting of the first other quad-chord truss to the one existing quad-chord truss;

aligning apertures on the one sides of the one existing quad-chord truss and the first other quad-chord truss; and inserting the first pin in the aligned apertures on the one sides of the one existing quad-chord truss and the first other quad-chord truss.

14. An erected platform according to claim 13 wherein the steps further comprise:

applying a portion of the decking on the first and second other quad-chord trusses so that it has an edge adjacent a location of the connector members on the first and second other quad-chord trusses for attachment of one of the cross beams thereto; and attaching the one cross beam to the connectors on the first and second other quad-chord trusses.

* * * * *